US007212113B2

(12) United States Patent
Zanovitch

(10) Patent No.: US 7,212,113 B2
(45) Date of Patent: May 1, 2007

(54) PASSENGER AND ITEM TRACKING WITH SYSTEM ALERTS

(75) Inventor: Joseph P. Zanovitch, Barton, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 155 days.

(21) Appl. No.: 10/837,645

(22) Filed: May 4, 2004

(65) Prior Publication Data

US 2005/0248450 A1 Nov. 10, 2005

(51) Int. Cl.
*G08B 21/12* (2006.01)

(52) U.S. Cl. ..... 340/540; 340/518; 340/5.1; 340/5.2; 340/10.1

(58) Field of Classification Search ..... 340/540, 340/568.1, 5.1, 555, 10.1, 545.2, 518, 541, 340/521, 5.3, 5.2; 378/8, 57, 63, 86, 88; 382/131

See application file for complete search history.

(56) References Cited

U.S. PATENT DOCUMENTS

| | | | |
|---|---|---|---|
| 3,678,278 | A | 7/1972 | Peil |
| 3,695,462 | A | 10/1972 | Sullivan |
| 3,776,395 | A | 12/1973 | Lilngg et al. |
| 4,137,567 | A | 1/1979 | Grube |
| 4,210,811 | A | 7/1980 | Dennhoven et al. |
| 4,416,435 | A | 11/1983 | Szendrodi et al. |
| 4,471,039 | A | 9/1984 | Borsenberger et al. |
| 4,604,704 | A | 8/1986 | Eaves et al. |
| 4,634,849 | A | 1/1987 | Klingen |
| 4,879,735 | A | 11/1989 | Owens |
| 5,153,439 | A | 10/1992 | Gozani et al. |
| 5,182,764 | A | 1/1993 | Peschmann et al. |
| 5,363,951 | A | 11/1994 | Mensch |
| 5,367,552 | A | 11/1994 | Peschmann |
| 5,373,538 | A | 12/1994 | Grenier et al. |
| 5,479,023 | A | 12/1995 | Bartle |

(Continued)

FOREIGN PATENT DOCUMENTS

| | | |
|---|---|---|
| CA | 2443469 | 10/2002 |

(Continued)

OTHER PUBLICATIONS

Hi-Scan 6040i/7555i "X-ray Inspection Systems".

(Continued)

*Primary Examiner*—Davetta W. Goins
(74) *Attorney, Agent, or Firm*—Miles & Stockbridge; James T. Carmichael

(57) ABSTRACT

A dynamically configurable threat scanning machine management system is capable of tracking information associated with one ore more items and/or passengers. The central control computer network can transmit, among other things, operational software and threat profiles to the threat scanning machines, while the threat scanning machines can transmit, among other things, images, alarms, and performance data to the central computer that can be distributed to one or more operator stations and/or other command and control centers for review and analysis. The threat scanning machine management system can be arranged in a hierarchical manner which enables threat scanning machines at various locations to be connected into regional, national or international control centers. The tracked information and alarm generation and distribution allow, for example, comparison to other information to determine if an alarm or change in thresholds or sensitivity is warranted.

20 Claims, 42 Drawing Sheets

U.S. PATENT DOCUMENTS 5,490,218 A 2/1996 Krug et al.
5,600,303 A 2/1997 Husseiny et al.
5,600,700 A 2/1997 Krug et al.
5,642,393 A 6/1997 Krug et al.
5,692,029 A 11/1997 Husseiny et al.
5,793,639 A 8/1998 Yamazaki
5,796,802 A 8/1998 Gordon
5,802,289 A 9/1998 Oprescu
5,838,758 A 11/1998 Krug et al.
5,870,449 A 2/1999 Lee et al.
5,910,973 A 6/1999 Grodzins
5,949,842 A 9/1999 Schafer et al.
5,970,113 A 10/1999 Crawford et al.
5,974,111 A 10/1999 Krug et al.
5,991,764 A 11/1999 Sundaresan
6,014,628 A 1/2000 Kovarik, Jr.
6,018,562 A 1/2000 Willson
6,044,353 A 3/2000 Pugliese, III
6,088,423 A 7/2000 Krug et al.
6,145,653 A 11/2000 Mensch
6,158,658 A 12/2000 Barclay
6,218,943 B1 4/2001 Ellenbogen
6,222,452 B1 4/2001 Ahlstrom et al.
6,230,043 B1 5/2001 Johnson
6,256,404 B1 7/2001 Gordon et al.
6,265,977 B1 7/2001 Vega et al.
6,283,260 B1 9/2001 Yasuda, Sr.
6,335,688 B1 1/2002 Sweatte
6,335,960 B2 1/2002 Knigge et al.
6,345,113 B1 2/2002 Crawford et al.
6,359,886 B1 3/2002 Ujihara et al.
6,364,365 B1 4/2002 Caplan
6,370,222 B1 4/2002 Cornick, Jr.
6,460,681 B1 10/2002 Coutant et al.
6,472,984 B1 10/2002 Risi
6,507,278 B1 1/2003 Brunetti et al.
6,512,964 B1 1/2003 Quackenbush et al.
6,546,072 B1 4/2003 Chalmers
6,580,778 B2 6/2003 Meder
6,594,547 B2 7/2003 Manabe et al.
6,637,563 B1 10/2003 Ruckh
6,650,729 B2 11/2003 Braess et al.
6,668,990 B2 12/2003 Humiston, Jr.
6,707,879 B2 3/2004 McClelland et al.
6,721,391 B2 4/2004 McClelland et al.
6,791,487 B1 9/2004 Singh et al.
6,922,460 B2 * 7/2005 Skatter et al. ..... 378/57
6,946,300 B2 9/2005 Nguyen et al.
6,952,163 B2 10/2005 Huey et al.
6,970,088 B2 * 11/2005 Kovach ..... 340/572.1
6,982,960 B2 1/2006 Lee et al.
7,027,773 B1 4/2006 McMillin
2001/0015380 A1 8/2001 Good et al.
2002/0040928 A1 4/2002 Jalili et al.
2002/0069293 A1 6/2002 Natalio
2002/0107714 A1 8/2002 Whitlock et al.
2002/0134836 A1 9/2002 Cash et al.
2002/0172324 A1 11/2002 Ellengogen
2002/0176532 A1 11/2002 McClelland et al.
2002/0185358 A1 12/2002 Zeitler et al.
2002/0186862 A1 12/2002 McClelland et al.
2002/0191739 A1 12/2002 Allen et al.
2002/0198731 A1 12/2002 Barnes et al.
2003/0021583 A1 1/2003 Sadok
2003/0023592 A1 1/2003 Modica et al.
2003/0085163 A1 5/2003 Chan et al.
2003/0085281 A1 5/2003 Knowles et al.
2003/0100973 A1 5/2003 Quackenbush et al.
2003/0115340 A1 6/2003 Sagula et al.
2003/0118151 A1 6/2003 Menhardt
2003/0127511 A1 7/2003 Kelly et al.
2003/0128100 A1 7/2003 Burkhardt et al.
2003/0128806 A1 7/2003 Morrell
2003/0137415 A1 7/2003 Thomson
2003/0141411 A1 7/2003 Pandya et al.
2003/0147484 A1 8/2003 Olshansky et al.
2003/0152186 A1 8/2003 Jurczyk et al.
2003/0156679 A1 8/2003 Mori et al.
2003/0185340 A1 10/2003 Frantz
2003/0189094 A1 10/2003 Trabitz
2003/0214583 A1 11/2003 Sadok
2004/0001568 A1 1/2004 Impson et al.
2004/0010697 A1 1/2004 White
2004/0017887 A1 1/2004 Le et al.
2004/0021572 A1 2/2004 Schoen et al.
2004/0036623 A1 2/2004 Chung
2004/0054550 A1 3/2004 Cole et al.
2004/0148571 A1 7/2004 Lue
2005/0028091 A1 2/2005 Bordawekar et al.
2005/0031076 A1 2/2005 McClelland et al.
2005/0036470 A1 2/2005 Calvert
2005/0110672 A1 5/2005 Cardiasmenos et al.
2005/0190061 A1 9/2005 Trela
2005/0206514 A1 9/2005 Zanovitch et al.
2005/0237180 A9 10/2005 Boesch et al.
2005/0248450 A1 11/2005 Zanovitch
2005/0251397 A1 11/2005 Zanovitch et al.
2005/0251398 A1 11/2005 Zanovitch et al.

FOREIGN PATENT DOCUMENTS

CN 1428718 7/2003
DE 4210516 10/1993
EP 0 459 648 A1 12/1991
JP 6075978 3/1994
JP 2002 292372 A 10/2000
JP 2003 122879 A 4/2003
WO WO 90/12660 11/1990
WO WO 02/082290 A2 10/2002
WO WO 03/029844 A2 4/2003

OTHER PUBLICATIONS

Information Technology for Counterterrorism, Box 3.7, "Scenarios for Automated Evidence Combination" 4 pages.
Robert J. Edley, "Hold Baggage Screening Systems" Airport International, pp. 1-6.
L-3 Communications Security & Detection Systems, "L-3 Communications Secures Poland's First HBS Systems Award—Total Contract Valued at Approx. $1 Million", Airport International, pp. 1-2.
Bill Mawer, "Security Net—The Shape of Things To Come" Airport International, pp. 1-7.
RAPISCAN, "Rapiscan Advanced Technologies" pp. 1-2.
RAPISCAN 515, "X-Ray Screening System" pp. 1-2.
RAPISCAN 519, "advanced Portable X-Ray System" pp. 1-2.
RAPISCAN 520B, "X-Ray Screening System" pp. 1-2.
RAPISCAN 522B, pp. 1-2.
RAPISCAN 524, "X-Ray Screening System" pp. 1-2.
RAPISCAN 526, "X-Ray Screening System" pp. 1-2.
RAPISCAN 527, "X-Ray Screening System" pp. 1-2.
RAPISCAN 532H, pp. 1-2.
Affidavit of Joseph P. Zanovitch.
Tony Lee Orrd, "Is That A Gun Or Just A Security Test?" Government Computer News/GCN.com, Jun. 5, 2000, vol. 19, No. 14, p. 1-3.

* cited by examiner

Validian

Remote Management | Threat Management | Maintenance Server | TIP Management | Log Off | Help

STATUS

User Administration

Dnld | Comm

Communications

· No Response to Ping (TSA-023 07:23 AM)

| Employee ID | First Name | Last Name | Status | Access Level | Last Access |
|---|---|---|---|---|---|
| E130153 | Jane | Smith | Logged on HH-001 | 4 | 05/01/2003 12:03pm |
| E130154 | Edward | Chin | Logged on TSM-002 | 1 | 05/01/2003 09:04pm |
| E130155 | Joe | Zanovitch | Logged on CC-002 | 4 | 05/01/2003 09:04pm |
| E130156 | Bill | Bates | Suspended | 2 | 05/01/2003 09:04pm |
| E130157 | Joe | Porter | Logged off | 4 | 05/01/2003 09:04pm |
| E130158 | Mark | Gaug | Logged on TSM-003 | 1 | 05/01/2003 09:04pm |
| E130159 | Sheila | Curry | Logged on TSM-004 | 1 | 05/01/2003 09:04pm |
| E130160 | Dave | Matthews | Logged off | 3 | 05/01/2003 09:04pm |
| E130161 | Eunice | Kim | Logged off | 1 | 05/01/2003 12:03pm |
| E130162 | Jim | Bean | Logged on HH-003 | 3 | 05/01/2003 09:04pm |
| E130163 | Jane | Smith | Logged on HH-001 | 4 | 05/01/2003 12:03pm |
| E130164 | Edward | Chin | Logged on TSM-002 | 1 | 05/01/2003 09:04pm |

Unselect All

Create New User | View Selected User | Modify Selected User | Delete Selected User(s)

FIG. 21

Validian

STATUS

Dnld Comm

Communications

- No Response to Ping (TSA-023 07:23 AM)

Remote Management | Threat Management | Maintenance Server | TIP Management | Log Off | Help

System Administration

| Hostname | Type | IP Address | Connection Type | Commands |
|---|---|---|---|---|
| CC-001 | Parent | 24.12.225.44 | LAN | |
| CC-029 | CC | 128.226.29.33 | LAN | Sync Time \| Reboot \| Modify \| Delete |
| TSM-001 | TSM | 24.29.61.12 | Dialup | Get Software Versions \| Sync Time \| Reboot \| Modify \| Delete |
| TSM-002 | TSM | 66.129.0.128 | LAN | Get Software Versions \| Sync Time \| Reboot \| Modify \| Delete |
| TSM-003 | TSM | 128.109.1.99 | LAN | Get Software Versions \| Sync Time \| Reboot \| Modify \| Delete |

Add New Host

© 2003 Lockheed Martin Corporation

FIG. 24

Validian

STATUS

Dnld Comm

Communications

· No Response to Ping (TSA-023 07:23 AM)

Remote Management | Threat Management | Maintenance Server | TIP Management | Log Off | Help

Download Schedule

| Download | File | Date | Time | Locations |
|---|---|---|---|---|
| Dnld-001 | All | 05/20/2003 | 12:00pm | TSM-003 |
| Dnld-002 | Profile 2 | 05/21/2003 | 01:00pm | TSM-001, TSM-005, ... |
| Dnld-003 | Profile 4 | 05/23/2003 | 03:00am | CC-003, CC-001, |
| Dnld-004 | Profile 2 | 05/25/2003 | 05:00am | TSM-002 |
| Dnld-005 | Profile 3 | 05/26/2003 | 06:00am | All |

Schedule New Download

FIG. 25

Validian

STATUS

Remote Management | Threat Management | Maintenance Server | TIP Management | Log Off | Help

System Administration

Build | Comm

Communications

- No Response to Ping (TSA-023 07:23 AM)

Parent:

| Hostname | Type | IP Address | Status | Connection | Local Time |
|---|---|---|---|---|---|
| NER.CC-001 | CC | 24.28.114.9 | Online | LAN | 05/01/2003 12:03pm |

Children:

| Hostname | Type | IP Address | Status | Connection | Local Time |
|---|---|---|---|---|---|
| NER.JFK.HH-001 | HH | 24.26.165.15 | Online | LAN | 05/01/2003 12:03pm |
| NER.JFK.T6.CP2.CC-001 | CC | 24.26.165.15 | Online | LAN | 05/01/2003 09:04pm |
| NER.JFK.T6.CP2.TSM-002 | TSM | 24.26.165.15 | Online | Dialup | 05/01/2003 09:04pm |
| NER.JFK.T6.CP2.TSM-003 | TSM | 24.26.165.15 | Offline | Dialup | 05/01/2003 09:04pm |
| NER.JFK.T6.CP2.TSM-004 | TSM | 24.26.165.15 | Rebooting | LAN | 05/01/2003 09:04pm |
| NER.JFK.T6.CP2.TSM-005 | TSM | 24.26.165.15 | Repair | LAN | 05/01/2003 09:04pm |
| NER.JFK.T6.CP2.TSM-006 | TSM | 24.26.165.15 | Online | LAN | 05/01/2003 09:04pm |
| NER.JFK.T6.CP2.TSM-007 | TSM | 24.26.165.15 | Online | LAN | 05/01/2003 09:04pm |
| NER.JFK.T6.CP2.TSM-008 | TSM | 24.26.165.15 | Online | LAN | 05/01/2003 12:03pm |

Unselect All

Synchronize All Times | Reboot Selected Host(s)

Add New Host | View Selected Host | Modify Selected Host | Delete Selected Host(s)

© 2003 Lockheed Martin Corporation

FIG. 26

Validian

STATUS

Unld Comm

Communications

- No Response to Ping (TSA-023 07:23 AM)

Remote Management | Threat Management | Maintenance Server | TIP Management | Log Off | Help

Throughput Report

Report Filter

| | |
|---|---|
| Time Period/ Interval: | One day broken down by hour |
| Start Date: | 05/12/2003 |
| Location: | NER.JFK.T6.CP2.TSM-002 |
| Operator: | E130189 |
| Type: | Normal |

| Period | Processed Items | Manually Inspected | Alarms | False Alarms | Threats |
|---|---|---|---|---|---|
| 12:00am | 26 | 2 | 0 | 0 | 0 |
| 01:00am | 25 | 5 | 0 | 0 | 0 |
| 02:00am | 23 | 4 | 0 | 0 | 0 |
| 03:00am | 8 | 1 | 0 | 0 | 0 |
| 04:00am | 19 | 1 | 0 | 0 | 0 |
| 05:00am | 55 | 2 | 0 | 0 | 0 |
| 06:00am | 100 | 23 | 0 | 0 | 0 |
| 07:00am | 123 | 18 | 2 | 2 | 0 |
| 08:00am | 160 | 10 | 4 | 4 | 0 |
| 09:00am | 189 | 22 | 3 | 3 | 0 |

FIG. 27

Validian

STATUS

Unid Comm

Communications

- No Response to Ping (TSA-023 07:23 AM)

Remote Management | Threat Management | Maintenance Server | TIP Management | Log Off | Help

Personnel Report

| Report Filter | |
|---|---|
| Location: | All |
| Operator | All |

| Location | Operator | Screener #1 | Screener #2 | Screener #3 |
|---|---|---|---|---|
| TSM-001 | jzanovitch | jmichael | echin | N/A |
| TSM-002 | mgaug | edavid | blu | N/A |
| TSM-003 | scurry | jcarter | dbailey | jnicholson |
| TSM-004 | jporter | poakenfield | rstone | bstrathmore |

© 2003 Lockheed Martin Corporation.

FIG. 28

Validian

STATUS

Dnld Comm

Communications

· No Response to Ping (TSA-023 07:23 AM)

Remote Management | Threat Management | Maintenance Server | TIP Management | Log Off | Help

Current Alarm Report

Report Filter

Location: All

| Time | Confirmed Time | Location | Classification Clearing Status | Image Viewer |
|---|---|---|---|---|
| 12:00am | 12:03am | TSM-003 | 0 | view |
| 01:00am | 01:05am | TSM-003 | 0 | N/A |
| 02:00am | 02:07am | TSM-001 | 0 | N/A |
| 03:00am | 03:01am | TSM-007 | 0 | N/A |

© 2003 Lockheed Martin Corporation

FIG. 29

Validian

STATUS

Remote Management | Threat Management | Maintenance Server | TIP Management | Log Off | Help

Historical Bag/Threat Information

General Overview Report

Unld | Comm

Communications

- No Response to Ping (TSA-023 07:23 AM)

| Report Filter | |
|---|---|
| Time Period: | One month |
| Machine ID: | All |
| Operator: | All |

| Bag ID | Machine ID | Date/Time | Threat Type | Supervisor Resolution |
|---|---|---|---|---|
| B000101 | NER.JFK.T6.CP2.TSM-002 | 05/26/2003 05:43pm | Weapon | Threat successfully cleared. |
| B000102 | NER.JFK.T6.CP2.TSM-004 | 05/29/2003 05:43pm | Explosive | Threat successfully cleared. |
| B012433 | NER.JFK.T6.CP2.TSM-001 | 05/30/2003 05:43pm | Weapon | Threat successfully cleared. |
| B064321 | NER.JFK.T6.CP2.TSM-006 | 06/14/2003 05:43pm | Explosive | Threat successfully cleared. |

Back

© 2003 Lockheed Martin Corporation

FIG. 30

Validian

STATUS

Dnld Comm

Communications

- No Response to Ping (TSA-023 07:23 AM)

Remote Management | Threat Management | Maintenance Server | TIP Management | Log Off | Help

Threat Type Information

General Overview Report

Report Filter

Threat Category: All

| Threat ID | Threat Category | Threat First Detected |
|---|---|---|
| D873SDGP02 | Explosive | Bag ID: RJ90S3D |
| T1038472 | Weapon | Bag ID: B029387 |
| T1238374 | Weapon | Bag ID: B282038 |
| T3904842 | Weapon | Bag ID: B212822 |

Back

© 2003 Lockheed Martin Corporation

FIG. 31

Validian

STATUS

Remote Management | Threat Management | Maintenance Server | TIP Management | Log Off | Help Unld | Comm

Communications

- No Response to Ping (TSA-023 07:23 AM)

All Actions Taken Information

General Overview Report

| Report Filter | |
|---|---|
| Time Period: | Month |
| Machine ID: | All |
| Operator: | All |

| Location | Operator | Date/Time | Action |
|---|---|---|---|
| TSM-002 | E103189 | 05/02/2003 08:03pm | Cleared Threat 1 of 3 |
| TSM-001 | E135468 | 05/04/2003 08:03pm | Cleared Threat 1 of 1 |
| TSM-004 | E198465 | 05/05/2003 08:03pm | Cleared Threat 1 of 2 |
| TSM-021 | E130111 | 05/08/2003 08:03pm | Cleared Threat 3 of 3 |

Back

FIG. 32

Remote Management | Threat Management | Maintenance Server | TIP Management | Log Off | Help Validian

STATUS

File Management

Dnld | Comm

Communications

· No Response to Ping (TSA-023 07:23 AM)

| Filename | Description | Owner | Version | Type | Build Date |
|---|---|---|---|---|---|
| F000374 | Maintenance Server Software | E130189 | 1.2 | Config | 05/01/2003 |
| F000375 | TSM firmware | E130190 | 3.1 | SM | 05/01/2003 |
| F000376 | Control Center Software | E130165 | 5.0 | Control | 05/01/2003 |
| F000377 | CC Antivirus Software | E130166 | 1.1 | Exe | 05/01/2003 |
| F000378 | Control Center Software | E130198 | 1.1 | Config | 05/01/2003 |
| F000379 | CT Software | E154123 | 1.6 | CT | 05/01/2003 |
| F000380 | SM Software | E130189 | 1.01 | SM | 05/01/2003 |
| F000381 | SM firmware | E130190 | 6.6 | SM | 05/01/2003 |
| F000382 | Threat Management Software | E130165 | 1.02 | Config | 05/01/2003 |
| F000383 | Remote Management Software | E130166 | 1.41 | Control | 05/01/2003 |
| F000384 | Threat Library - Hand Guns | E130198 | 1.11 | SM | 05/01/2003 |
| F000385 | Threat Library - Small Bombs | E154123 | 1.0 | Exe | 05/01/2003 |
| F000386 | Threat Library - Rifles | E130189 | 3.0 | Config | 05/01/2003 |
| F000387 | Threat Library - Kitchen Knives | E130190 | 2.2 | SM | 05/01/2003 |

Unselect All

Add New File | Update Selected File | View Selected File Details | Delete Selected File(s)

© 2003 Lockheed Martin Corporation

FIG. 33

Validian

Remote Management | Threat Management | Maintenance Server | TIP Management | Log Off | Help

STATUS

Profile Management

Unid | Comm

Communications

- No Response to Ping (TSA-023 07:23 AM)

| Profile ID | Description | Creator | Files | Type | Creation Date |
|---|---|---|---|---|---|
| P000374 | Updated Control Center Software | E130189 | 10 | Control | 05/01/2003 |
| P000375 | Updated TSM firmware | E130159 | 25 | SM | 05/01/2003 |
| P000376 | Updated Control Center Software | E130186 | 1 | Control | 05/01/2003 |
| P000377 | Updated Control Center Software | E130120 | 15 | Control | 05/01/2003 |
| P000378 | Updated Control Center Software | E130121 | 12 | Control | 05/01/2003 |
| P000379 | Updated Control Center Software | E130122 | 13 | Control | 05/01/2003 |
| P000380 | Updated TSM firmware | E130160 | 4 | SM | 05/01/2003 |
| P000381 | Updated TSM firmware | E130178 | 6 | SM | 05/01/2003 |
| P000382 | Updated Control Center Software | E195189 | 15 | Control | 05/01/2003 |
| | Updated Control | | | | |

Unselect All

Create New Profile | View Selected Profile Details | Delete Selected Profile(s)

© 2003 Lockheed Martin Corporation

FIG. 34

Validian

Remote Management | Threat Management | Maintenance Server | TIP Management | Log Off | Help

STATUS

Download Management

Dnld | Comm

Communications

· No Response to Ping (TSA-023 07:23 AM)

| Download ID | Profile ID | Date | Time |
|---|---|---|---|
| D000383 | P000374 | 05/20/2003 | 10:00am |
| D000408 | P000375 | 05/20/2003 | 10:00am |
| D000409 | P000376 | 05/20/2003 | 10:00am |
| D000410 | P000377 | 05/20/2003 | 10:00am |
| D000411 | P000378 | 05/20/2003 | 10:00am |
| D000412 | P000379 | 05/20/2003 | 10:00am |
| D000413 | P000400 | 05/20/2003 | 10:00am |

Unselect All

Schedule New Download | View/ Modify Selected Download | Delete Selected Download(s)

© 2003 Lockheed Martin Corporation

FIG. 35

Validian

Remote Management | Threat Management | Maintenance Server | TIP Management | Log Off | Help

STATUS

TIP Image Management

Dald | Comm

Communications

· No Response to Ping (TSA-023 07:23 AM)

| Image | Truth description | Threat Type | Date |
|---|---|---|---|
| I000374 | Rifle | Weapon | 05/01/2003 |
| I000375 | BB gun | Weapon | 05/01/2003 |
| I000376 | Missile | Weapon | 05/01/2003 |
| I000377 | Bomb | Explosive | 05/01/2003 |
| I000378 | Handgun | Weapon | 05/01/2003 |
| I000379 | Semi-automatic handgun | Weapon | 05/01/2003 |
| I000380 | Corkscrew | Weapon | 05/01/2003 |
| I000381 | Bomb | Explosive | 05/01/2003 |
| I000382 | Pocket knife | Weapon | 05/01/2003 |
| I000383 | Bomb | Explosive | 05/01/2003 |
| I000384 | Large knife | Weapon | 05/01/2003 |
| I000385 | Large knife | Weapon | 05/01/2003 |
| I000386 | Bomb | Explosive | 05/01/2003 |
| I000387 | Scissors | Weapon | 05/01/2003 |
| I000388 | Bomb | Explosive | 05/01/2003 |
| I000389 | Small knife | Weapon | 05/01/2003 |
| I000390 | Bomb | Explosive | 05/01/2003 |
| I000391 | Letter opener | Weapon | 05/01/2003 |
| I000392 | Bat | Weapon | 05/01/2003 |

Unselect All

Add New Image | View Selected Image | Delete Selected File(s)

© 2003 Lockheed Martin Corporation

FIG. 36

PASSENGER AND ITEM TRACKING WITH SYSTEM ALERTS

Threat scanning machines are often employed in locations where safety and security are at issue. Transportation facilities, for example, airports, train stations, seaports, and the like, may employ threat scanning machines to detect security threats within passenger or freight baggage. Other facilities, such as office buildings, government buildings, court houses, museums, and the like, may also employ threat scanning machines to detect, for example, restricted items being carried by a person seeking entry to the facility. A threat scanning machine, as used herein, refers to any device capable of scanning an item to detect an object defined as a threat, or any object that combined with one or more other objects is or is capable of being a threat. A threat, as used herein, can be anything that is restricted from being brought aboard a vehicle, into a building or into an area.

Threat scanning machines may be of different make and model, including carry-on bag scanning machines, checked-bag scanning machines, walk-through metal detectors, x-ray scanners, computerized tomography devices, magnetic resonance imaging devices, cargo and freight scanners, package scanners, and the like, thus requiring individualized maintenance and control of each machine's software and data components. The task of individually maintaining and controlling each machine may be time consuming, prone to error and expensive. For example, when supervisor attention is required at a particular machine, the supervisor must physically go to the machine, assess the situation and provide guidance to the threat scanning machine operator. As another example, when the software in an existing threat scanning machine needs to be upgraded, the media containing the upgrade may be required to be carried from machine to machine in order to perform the upgrade. The diversity of threat scanning machine types and the varied locations of threat scanning machines pose obstacles to the efficient management of the threat scanning machines.

In an exemplary embodiment of the threat scanning machine management system, the threat scanning machines are connected to a communication network. One or more command and control center computers are connected to the communication network. The threat scanning machines, possibly of different make and model, are adapted with hardware and software to allow them to communicate over the network with the command and control center computer. The command and control center computer is adapted with software and/or hardware to control and manage threat scanning machines. In another exemplary embodiment of the present invention, the command and control computer can transmit data, such as, for example, operational software and threat profiles to the threat scanning machine; and the threat scanning machines may transmit data, such as, for example, images and performance data to the command and control computer.

In yet another exemplary embodiment of the present invention, a supervisor may view the images or performance data of a threat scanning machine remotely on the control center computer, assess the situation and assist the threat scanning machine operator remotely, thereby permitting the supervisor to manage multiple threat scanning machines in an efficient manner. In still another exemplary embodiment of the present invention, the threat scanning machine management system may be dynamically configurable, the network may be a wireless network, and the command and control center computer may be a portable device, thus permitting a superior to manage the threat scanning machines while remaining mobile. In still another exemplary embodiment, a group of operators within an operator pool are used to scan images associated with scanned items to check for threats, and alarms are sent based on, for example, detected threats, automatically, manually or some combination thereof.

BRIEF DESCRIPTION OF THE DRAWINGS

FIG. 21 is an illustration of an exemplary embodiment of the threat scanning machine management system user interface showing User Administration data;

FIG. 24 is an illustration of an exemplary embodiment of the threat scanning machine management system user interface showing System Administration data;

FIG. 25 is an illustration of an exemplary embodiment of the threat scanning machine management system user interface showing a download schedule;

FIG. 26 is an illustration of an exemplary embodiment of the threat scanning machine management system user interface showing the System Administration screen;

FIG. 27 is an illustration of an exemplary embodiment of the threat scanning machine management system user interface showing a Throughput Report;

FIG. 28 is an illustration of an exemplary embodiment of the threat scanning machine management system user interface showing a Personnel Report;

FIG. 29 is an illustration of an exemplary embodiment of the threat scanning machine management system user interface showing a Current Alarm Report;

FIG. 30 is an illustration of an exemplary embodiment of the threat scanning machine management system user interface showing an Historical Bag/Threat Information Report;

FIG. 31 is an illustration of an exemplary embodiment of the threat scanning machine management system user interface showing a Threat Type Information Report;

FIG. 32 is an illustration of an exemplary embodiment of the threat scanning machine management system user interface showing an All Actions Taken Information Report;

FIG. 33 is an illustration of an exemplary embodiment of the threat scanning machine management system user interface showing a File Management Report;

FIG. 34 is an illustration of an exemplary embodiment of the threat scanning machine management system user interface showing a Profile Management Report;

FIG. 35 is an illustration of an exemplary embodiment of the threat scanning machine management system user interface showing a Download Management Report;

FIG. 36 is an illustration of an exemplary embodiment of the threat scanning machine management system user interface showing a TIP Image Management Report;

DETAILED DESCRIPTION

While the exemplary embodiments illustrated herein may show the various components of the threat scanning machine, and corresponding command and control center, collocated, it is to be appreciated that the various components of the system can be located at distant portions of a distributed network, such as a telecommunications network and/or the Internet or within a dedicated communications network. Thus, it should be appreciated that the components of the threat scanning machine, the command and control center, and tracking and analysis module, respectively, can be combined into one or more devices or collocated on a particular node of a distributed network, such as a telecommunications network. As will be appreciated from the following description, and for reasons of computational efficiency, the components can be arranged at any location within the distributed network without affecting the operation of the system. Also, the exemplary embodiments shown provide a layout of the system in which the subsystems (i.e. Threat Management, Remote Management, and Maintenance Server) are shown separately for conceptual clarity and for illustrative purposes in both the threat scanning machines and the command and control center. However, it should be appreciated, that other layouts, groupings, and/or arrangements of the subsystems within the system may be used. Furthermore, while the exemplary embodiment will be discussed in relation to one or more command and control centers, it should be appreciated that the systems and methods of this invention can work equally well without a command and control center architecture. For example, the logic and accompanying hardware/software functionality of the command and control center(s) can be distributed throughout one or more of the remaining components of the architecture, such as in the threat scanning machine(s), for example, in a distributed peer-to-peer network, or the like.

Furthermore, it should be appreciated that the various links connecting the elements can be wired or wireless links, or a combination thereof, or any known or later developed element(s) that is capable of supplying and/or communicating data to and from the connected elements. Additionally, the term module as used herein can be any hardware, software of combination thereof that is capable of performing the functionality associated therewith.

Figure 1:
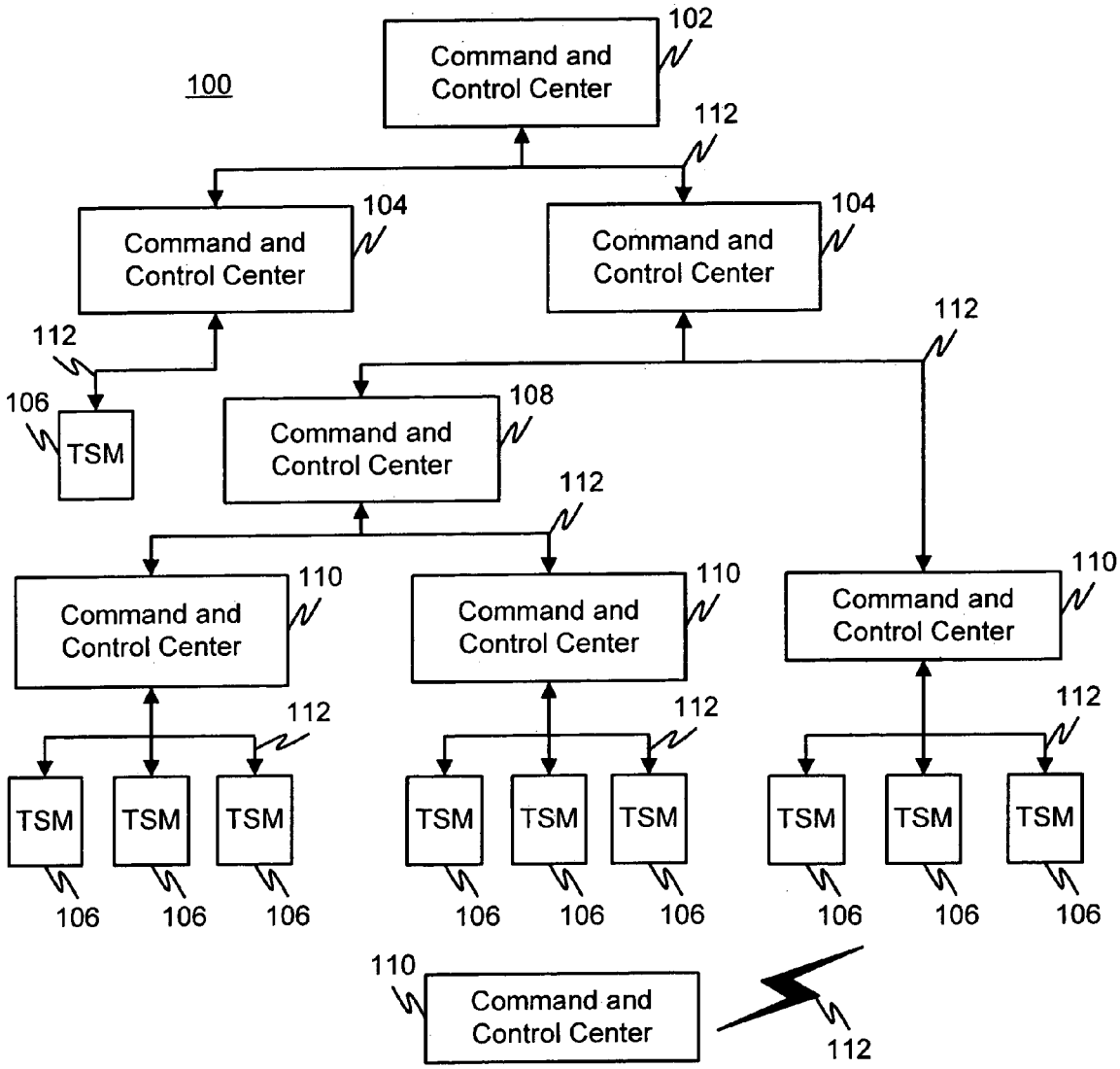
FIG. 1 is a functional block diagram of an exemplary embodiment of a threat scanning machine management system.

FIG. 1 shows a functional block diagram of an exemplary embodiment of a threat scanning machine management system 100. In particular, a command and control center 102 forms a top level of a system hierarchy and is interconnected by a network 112 to a next level comprising command and control centers 104. A command and control center 104 is interconnected with a threat scanning machine 106 by the network 112. A command and control center 104 is interconnected to command and control center 108 and to command and control center 110 via the network 112. A command and control center 110 is interconnected to one or more threat scanning machines 106 via the network 112.

The threat scanning machine management system 100 shown in FIG. 1 represents, for purposes of illustration, an exemplary configuration of command and control centers connected to each other and to threat scanning machines. However, it should be appreciated that the system 100 can be configured in order to be adaptable to various contemplated uses of the present invention. The configuration of the system 100 may be static or dynamic depending on contemplated uses of the invention. In an exemplary embodiment, a transportation facility may have an existing network (not shown), and in such a case, the threat scanning machine management system 100 may be adapted to the existing network. Alternatively, in another exemplary embodiment, if an existing network within a transportation facility is insufficient to be able to be adapted to meet the communications requirements of the threat scanning machine management system 100 for any reason, such as low bandwidth or poor security, for example, then a new network can be installed for the threat scanning machine management system 100 to communicate over. However, it should be appreciated that any communications medium that allows the threat scanning machines and the control centers to communicate may be used with equal success. In an exemplary embodiment of the invention, the command and control centers and the threat scanning machines communicate over the network 112 using standard protocols common in the industry. Examples of standard protocols include, for example, hypertext transfer protocol. (HTTP), Internet Inter-ORB Protocol (IIOP), Remote Method Invocation (RMI), Simple Mail Transfer Protocol (SMTP), Secured Sockets Layer (SSL), Secure Hypertext Transfer Protocol (SHTTP) and the like. Examples of a network 112 include wired or wireless solutions such as Ethernet, fiber optic, or the like. However, it should be appreciated that any present or future developed networks and/or network protocols which perform the tasks required for a command and control center to communicate with a threat scanning machine may be used with equal success according to the present invention.

In operation, the exemplary command and control center 110 communicates with one or more threat scanning machines 106 via the network 112. The command and control center 110 may transmit data to the threat scanning machine, for example, operational software, authorized users and credentials, threat profiles, etc. The operational software may comprise any combination of software for the operation of the scanning system and/or software for the operation of the management system 100. The authorized users and credentials may include, for example, a list of user login names and passwords. Threat profiles may include data that the threat scanning machine uses to aid in identification of threats, for example the shape of potential threat items, and/or the physical properties of an item that may indicate a potential threat. However, it should be appreciated that the data transmitted from the command and control center 110 to the threat scanning machine 106 may be any data required for the management and operation of the threat scanning machine 106 and could be used with equal effectiveness according to the present invention.

The exemplary threat scanning machine 106 communicates with the command and control center 110. The threat scanning machine 106 may receive data from the command and control center 110 and/or may transmit data to the command and control center 110. The data that the threat scanning machine may transmit to the command and control center 110 may include, for example, performance data, requests for operator assistance, threat detection data, and/or the like.

The exemplary command and control center 110 may communicate with one or more command and control centers 104 and/or 102. In the exemplary embodiment shown in FIG. 1, the command and control centers 110 are interconnected to command and control centers 104. The command and control centers 104 are interconnected to command and control center 102. In this exemplary embodiment and configuration of the present invention control centers are arranged in a hierarchical manner to provide for the centralized management of many threat scanning machines 106 from a central command and control center 102, thus providing more efficient management of the threat scanning machines 106.

Figure 2:
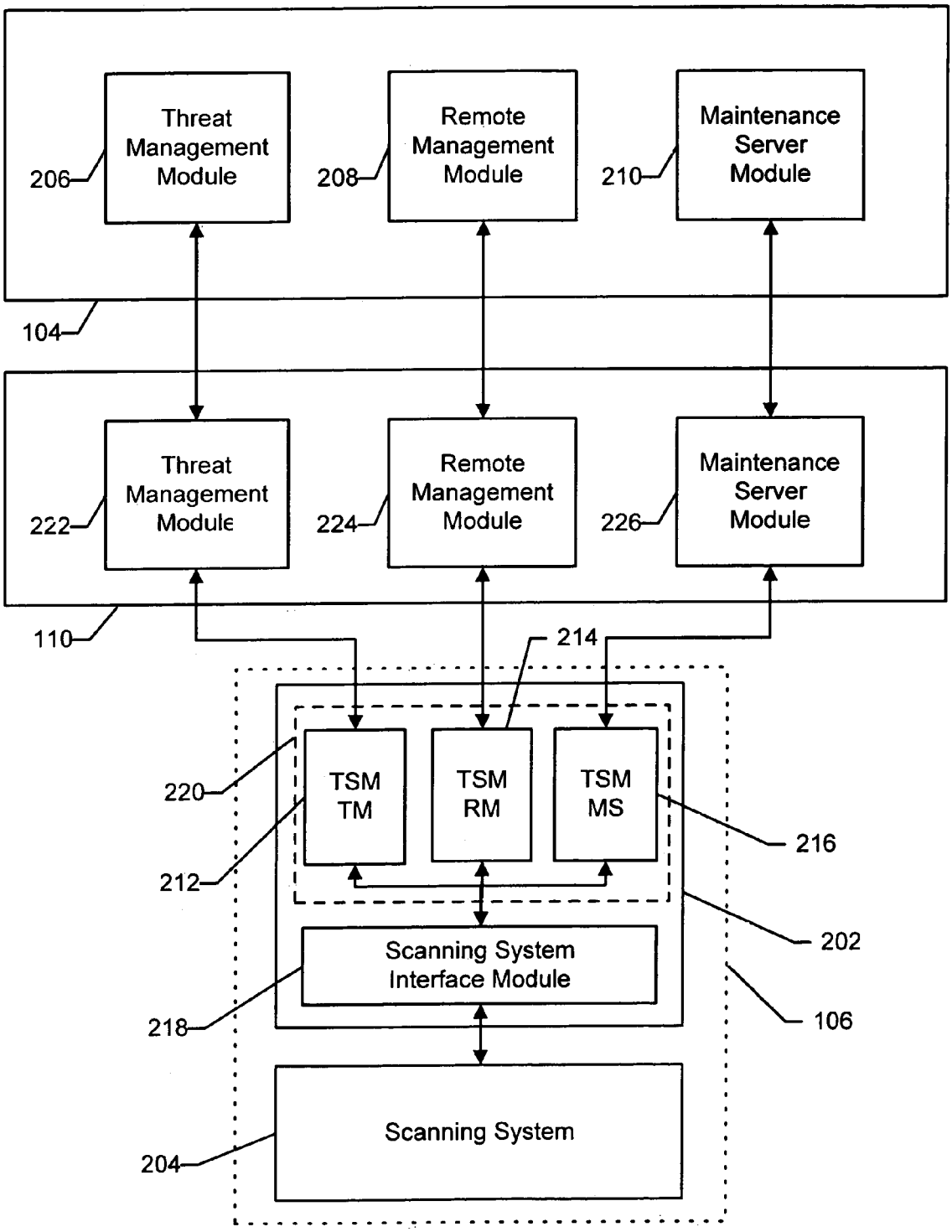
FIG. 2 is a functional block diagram of an exemplary embodiment of a threat scanning machine management system showing the control centers connected to a threat scanning machine in accordance with the present invention.

FIG. 2 is a functional block diagram of an exemplary embodiment of a threat scanning machine management system. In particular, a command and control center 104 at one level is interconnected with a command and control center 110 of another level. The command and control center 104 comprises, in addition to standard control center components, a threat management module 206, a remote management module 208 and a maintenance server module 210. The exemplary command and control center 110 comprises, in addition to standard control center components, a threat management module 222, a remote management module 224 and a maintenance server module 226. The exemplary command and control center 110 is interconnected to one or more exemplary threat scanning machines 106. The exemplary threat scanning machines 106 comprise, in addition to standard threat scanning machine components, a threat scanning machine computer 202 and a scanning system 204.

The exemplary threat scanning machine computer 202 comprises, in addition to standard computer hardware and software components, a management system interface module 220 and a scanning system interface module 218. The management system interface module 220 comprises a threat management module 212, a remote management module 214, and a maintenance server module 216. The exemplary threat management module 212, remote management module 214, and maintenance server module 216 are adapted to provide the interface and logic necessary for the threat scanning machine 106 to be connected to the threat scanning machine management system 100; these modules also communicate with the scanning system interface module 218. In an exemplary embodiment, the threat scanning machine computer 202 may be a standard PC. In another exemplary embodiment, the threat scanning machine computer 202 may be a specialized computer adapted specifically to control the threat scanning machine 106.

In yet another exemplary embodiment of the present invention, the threat scanning machine management system 100 may be designed to adapt to any existing threat scanning machine computer 202 in order to allow the threat scanning machine 106 to connect and communicate within the threat scanning machine management system.

In still another exemplary embodiment of the present invention, the management system interface module 220 can be housed in a computer separate from the threat scanning machine computer 202; this construction may be useful in situations where the execution of the management system interface module 220 may present too great a processing and/or communications burden for the threat scanning machine computer 202.

In operation, the exemplary threat management module 206 of the command and control center 104 communicates with the threat management module 222 of the command and control center 110. The threat management module 222 of the command and control center 110 communicates with the threat management module 212 of the threat scanning machine 106. The threat management information comprises any information related to the management of threats. Examples of such information include Threat Image Projections (TIPs), which are non-threat images with threats inserted into them for testing purposes, threats detected within a particular piece of baggage, or messages alerting the threat scanning machine operators to specific or general types of security risks that may be present or that may be attempted.

The exemplary remote management module 208 of the command and control center 104 communicates with the remote management module 224 of the command and control center 110. The remote management module 224 of the command and control center 110 communicates with the remote management module 214 of the threat scanning machine 106.

The exemplary maintenance server module 210 of the command and control center 104 communicates with the maintenance server module 226 of the command and control center 110. The maintenance server module 226 of the command and control center 110 communicates with the maintenance server module 216 of the threat scanning machine 106.

The command and control center 110 and the threat scanning machine 106 may communicate with each other using a predefined interface format. A predefined format allows for the command and control center 110 to be connected to any threat scanning machine 106 that has been adapted to work in accordance with the present invention. The tables below provide an example of a predefined interface between the command and control center 110 and the threat scanning machine 106. However, it should be appreciated that these tables merely represent an exemplary interface for illustration purposes. An actual interface may vary in both content and design, while still being used with equal success, depending on contemplated uses of the invention.

TABLE 1

| Interface Message |
|---|
| Operator Bag Information |
| Screener Bag Information |
| Threat Information |
| Alarm Information |
| TIP Truth Information |
| Event Information |
| User Keystroke Information |
| TIP Configuration |
| Threat Detection Configuration |

Table 1 shows the messages of an exemplary interface between the command and control center 110 and the threat scanning machine 106. In this exemplary interface the threat scanning machine 106 transmits messages to the command and control center 110, including, for example, Operator Bag Information, Screener Bag Information, Threat Information, Alarm Information, Threat Image Projection (TIP) Truth Information, Event Information, and/or User Keystroke Information. While the command and control center 110 transmits the TIP Configuration and Threat Detection Configuration messages to the threat scanning machine 106.

TABLE 2

| Operator Bag Information | |
|---|---|
| Field Name | Description |
| Machine ID | Unique Identifier of Threat Scanning Machine |
| Bag ID | Identification of the bag |
| TIP ID | Identification of the TIP image |
| Logon ID | Operator ID |
| Bag Start Date CT | Date bag entered CT (Computerized Tomography) |
| Bag Start Time CT | Time bag entered CT |
| Bag Start Date QR | Date bag entered QR (Quadrupole Resonance) |
| Bag Start Time QR | Time bag entered QR |
| Operator Start Date CT | Date operator received the image |
| Operator Start Time CT | Time operator received the image |
| Operator End Date CT | Date operator completed the transaction |
| Operator End Time CT | Time operator completed the transaction |
| Bag Size | Length and/or weight of bag |
| Number of Threats | Number of threats detected in this bag |
| Number of Keystrokes | Number of keystrokes used by operator |
| Machine Decision | Machine indication of possible threat present within bag |
| Operator Decision | Operator indication of possible threat present within bag |
| Image ID | File name if cannot be derived from Bag ID |

Table 2 shows the contents of an exemplary Operator Bag Information message. The Operator Bag Information message provides the command and control center 110 with information relating to a particular piece of baggage that has been scanned by the threat scanning machine 106.

In operation, the Operator Bag Information message is used to transmit information gathered by an operator on a particular bag. A supervisor or screener can review the Operator Bag Information message in assisting the operator in assessing a potential threat. Another use of the Operator Bag Information message may be to monitor the performance of an operator by placing a test bag containing a known threat or threat-like object in order to evaluate the operator's performance in identifying and assessing the potential threat. A further use of the Operator Bag Information message is to collect the messages over time in order to form statistical models of the operator bag information. These statistical models may then be used to further enhance the operation of the threat scanning machine management system.

TABLE 3

| Screener Bag Information | |
|---|---|
| Field Name | Description |
| Machine ID | Unique Identifier of Threat Scanning Machine |
| Bag ID | Identification of the bag |
| Logon ID | Screener ID |
| Screener Start Date CT | Date screener received the image |
| Screener Start Time CT | Time screener received the image |
| Screener End Date CT | Date screener completed the transaction |
| Screener End Time CT | Time screener completed the transaction |
| Number of Keystrokes | Number of keystrokes used by screener |
| Screener Decision | Determination of possible threat within bag |
| Screener Annotation | Screener's notes |

Table 3 shows the contents of an exemplary Screener Bag Information message. The Screener Bag Information message provides the command and control center 110 with information from a particular screener about a particular piece of baggage.

In operation, when a threat scanning machine and/or operator detect a potential threat, a screener may be called upon to search the bag physically. The Screener Bag Information message is used to transmit information gathered by a Screener on a particular bag, such as the results of the physical search, threats found or not found, and any action taken by security with regard to the passenger or the baggage. A supervisor can review the Screener Bag Information in assisting the screener and operator in assessing and dealing with a potential threat. Another use of the Screener Bag Information message may be to monitor the performance of a screener by placing a test bag containing a known threat or threat-like object in order to evaluate the screener's performance in identifying and assessing the potential threat. A further use of the Screener Bag Information message is to collect the messages over time and correlate them with other system data, such as operator bag messages, in order to form statistical models of the screener bag information. These statistical models may then be used to further enhance the operation of the threat scanning machine management system.

An important aspect of the present invention, achieved through the operator and screener bag information messages, is that baggage may be tracked and associated with a particular person as that person moves about from place to place, as discussed in more detail hereinafter. For example, the information about a particular person's bag may be gathered as the person travels from location to location. The threat scanning can then be augmented with historical bag information data in order to further inform the operator, screener, or supervisor of the need for further inspection of the bag. Additionally, the baggage may be associated with an owner or carrier and vice versa, thereby permitting the threat scanning machine management system to enhance the threat scanning with auxiliary information about the owner or carrier to further enhance the security.

TABLE 4

Threat Information

| Field Name | Description |
|---|---|
| Machine ID | Unique Identifier of Threat Scanning Machine |
| Bag ID | Identification of the bag |
| CT Compound Type | Detected compound type |
| CT Mass | Measured mass/density |
| CT Confidence | Algorithm confidence factor |
| QR Compound Type | Detected compound type |
| QR Mass | Detected mass |
| Viewed by operator | Identifies if operator viewed this particular threat |
| Operator Action | Identifies what action the operator took on a given threat |
| Machine Decision | Machine decision of threat/non-threat |
| Threat Category | Identifies category of threat (e.g. weapon, explosive, etc.) |
| Picture File Name | The name of the file containing the picture |

Table 4 above shows the contents of an exemplary Threat Information message. The Threat Information message provides the command and control center 110 with information about a particular threat detected by the threat scanning machine 106.

In operation, Threat Information messages may be transferred to the command and control center for assistance in assessment by a supervisor. Additionally, the supervisor in the command and control center may pass the message along to a more senior supervisor at a regional or national level command and control center. Further still, the system can be configured to automatically forward messages to higher levels in the hierarchy based on a pre-selected or dynamic criteria, such as threat type or threat category. In this manner a threat that once could only be viewed and assessed on site, may now be able to be assessed by numerous people with possibly increasing levels of expertise, thereby by making efficient use of the supervisor's time through a hierarchical system of review and assessment of potential threats. This process can be carried out in a very expeditious manner through the interconnection of the threat scanning machine and the command and control centers on a distributed network. A further use of the Threat Information message is for the threat management system as a whole to scan for incidents of like or similar threats and alert supervisors and threat scanning machine operators to patterns in the data which may indicate a security breach is being attempted. Still another use of the Threat Information message is to gather information on things that have been identified as threats, but in actuality are only items of interest for purposes other than security. For example, the threat scanning machine could possibly be configured to monitor for aerosol cans within baggage and record statistics related to their occurrence in the baggage. This type of statistical information on "threats" could be used to guide policies regarding acceptable items, for general research into items in baggage, or for other such purposes. In yet another use of the Threat Information messages, the data may be collected over time and used to build statistical models of potential threats and their rates of occurrence. These statistical models could be fed back into the threat management system in order to improve the accuracy, security, and management efficiency of the threat scanning machine management system.

TABLE 5

Alarm Information

| Field Name | Description |
|---|---|
| Machine ID | Unique Identifier of the Threat Scanning Machine |
| Bag ID | Identification of the bag |
| Alarm Severity | Identifies the severity of the alarm (e.g. nail clippers may be low, scissors may be medium, and gun/knife may be high) |
| Threat Category | Identifies category of threat (e.g. weapon, explosive, etc.) |
| Threat Confirmed | Annotation indicating if a threat was actually found |

Table 5 shows the contents of an exemplary Alarm Information message. The Alarm Information message provides the command and control center 110 with information about a particular alarm from the threat scanning machine 106.

In operation, the Alarm Information messages provide information useful to achieving management goals. As a current situational awareness indication, the Alarm Information may be transferred both vertically (i.e. from threat scanning, machine to command and control center and on up the chain of command and control centers) and horizontally (i.e. threat scanning machine to threat scanning machine) in order to inform management and other operators of threat events in a real time manner. This real-time reporting of threat event information makes an added dimension in security response possible, namely one of recognizing a looming security risk that may be geographically disbursed. By utilizing threat scanning machine management systems in multiple countries it would even be possible for nations to collectively detect and recognize a global security threat event that was in the early stages of being carried out. By collecting Alarm Information messages over time, statistical trends may be analyzed to aid management in improving the efficiency and security of the threat scanning machines.

TABLE 6

| Event Information | |
|---|---|
| Field Name | Description |
| Machine ID | Unique Identifier of the Threat Scanning Machine |
| Logon ID | User ID |
| Event Date CT | Date event happened |
| Event Time CT | Time event happened |
| Event Code | Code responding to event |
| Event Detail | Text message about event |

Table 6 shows the contents of an exemplary Event Information message. The Event Information message provides the command and control center 110 with information about a particular event that occurred at a threat scanning machine 106.

In operation the Event Information messages provide information useful to achieving management goals. As a current situational awareness indication, the Event Information message may be transferred both vertically (i.e. from threat scanning machine to command and control center and on up the chain of command and control centers) and horizontally (i.e. threat scanning machine to threat scanning machine) in order to inform management and other operators of threat events in a real-time manner. This real-time nature of the reporting of threat event information brings a new dimension in security response, namely one of recognizing a looming security risk that may be geographically distributed. By collecting Event Information messages over time, statistical trends may be analyzed to aid management in improving the efficiency and security of the threat scanning machines.

TABLE 7

| User Keystroke Information | |
|---|---|
| Field Name | Description |
| Machine ID | Unique Identifier of the Threat Scanning Machine |
| Logon ID | User ID |
| Bag ID | Identification of the bag |
| Keystroke Count | Number of keystrokes |
| Keystroke 1 | Keystroke code |
| Timestamp 1 | Time keystroke occurred |
| Keystroke 2 | Keystroke code |
| Timestamp 2 | Time keystroke occurred |
| . | . |
| . | . |
| . | . |
| Keystroke n | Keystroke code |
| Timestamp n | Time keystroke occurred |

Table 7 shows the contents of an exemplary User Keystroke Information message. The User Keystroke Information message provides the command and control center 110 with details from the threat scanning machine 106 regarding the keystrokes of a user in the processing of a particular piece of baggage.

In operation, the User Keystroke Information message can be used for several management and supervisory purposes. The keystroke information may be used as a training aid by permitting supervisor to oversee the keystrokes used by a scanning machine operator and determine if the operator has used the scanning effectively, or if further training is needed in a particular area. Further, the keystroke information may be collected over time to study the efficiency of the threat scanning machine operators. Further still, the keystroke information may provide additional details to a supervisor who is assisting a scanning machine operator with a possible threat presence. Yet another use of the keystroke information may be to correlate the keystroke information with the image data and recreate, or playback, what took place at a particular machine to look for suspicious activity by the operator or as an aid in analyzing machine performance and debugging the threat scanning machine software.

An important aspect of the threat scanning machine management system is that it is capable of managing both the threat scanning machine equipment and the personnel operating the threat scanning machines.

Figure 3:
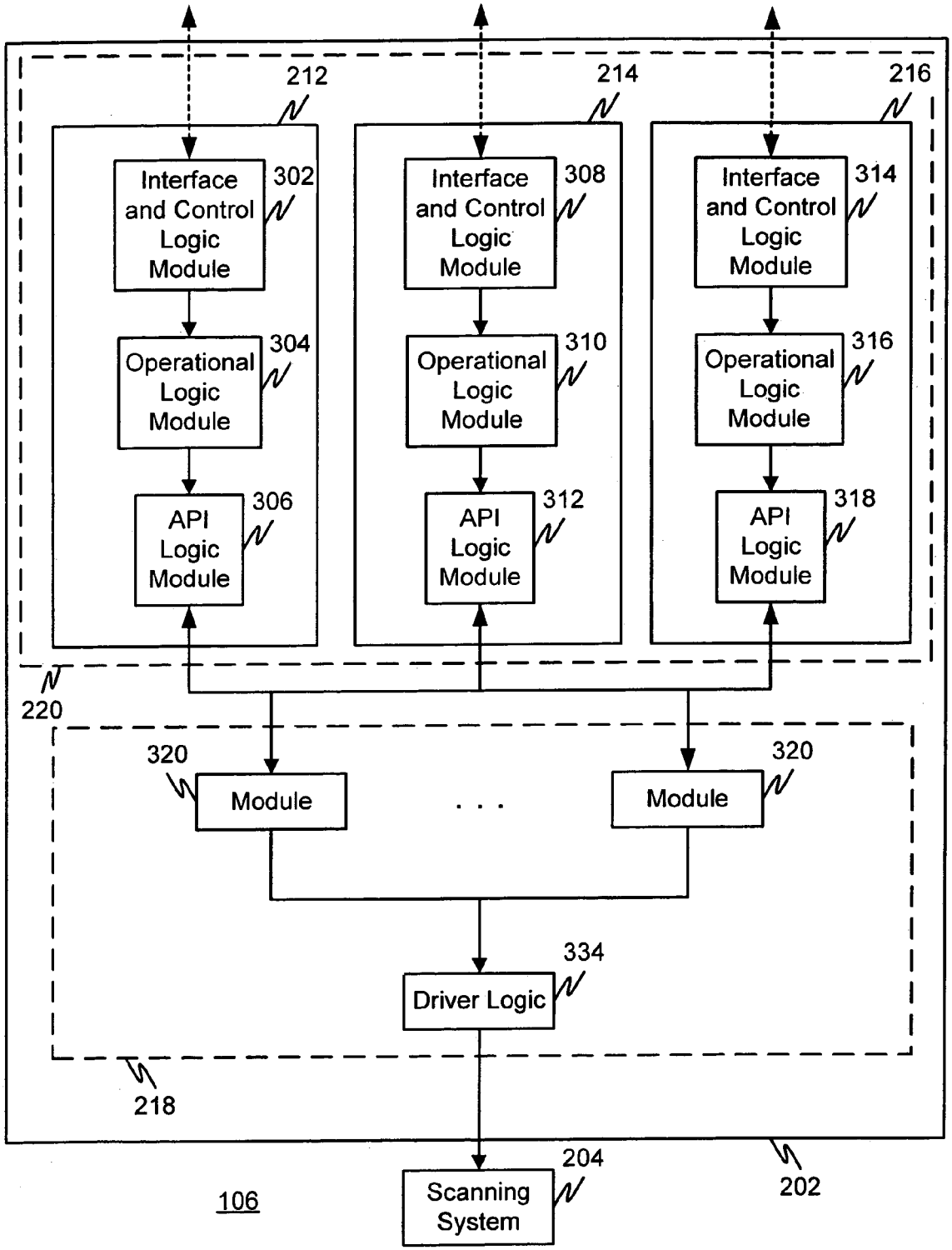
FIG. 3 is a functional block diagram of an exemplary embodiment of a threat scanning machine management system showing the details of an exemplary threat scanning machine in accordance with the present invention.

FIG. 3 is a functional block diagram of an exemplary threat scanning machine 106. In particular, the threat scanning machine 106 comprises, in addition to the standard threat scanning machine components, a computer 202 and a scanning system 204. The computer 202 comprises, in addition to standard computer components, a management system interface module 220 and a scanning system interface module 218. The management system interface module 220 comprises a threat management module 212, a remote management module 214, and a maintenance server module 216. The scanning system interface module 218 comprises one or more interface modules 320, and, optionally, a low level driver module 334. The threat management module 212 comprises an interface and control logic module 302, an action logic module 304, and an Application Programming Interface (API) logic module 306. The remote management module 214 comprises an interface and control logic module 308, an action logic module 310 and an API logic module 312. The maintenance server module 216 comprises an interface and control logic module 314, an operational logic module 316, and an API logic module 318.

In operation, the threat scanning machine computer 202 executes the management system interface module 220 and the threat scanning machine physical machine interface software 218.

The exemplary interface and control logic module 302 contains the logic necessary for the connection and communication with the threat management module within the control computer. The Operation Logic module 304 contains operational logic. The application programming interface (API) module 306 contains the logic necessary for interfacing with the scanning system interface module 218.

The remote management module 214 contains an interface and control logic module 308 that contains the logic necessary for the connection and communication with the remote management module in a command and control center. The operational logic module 310 contains operational logic and an application programming interface (API) component 312 that contains the logic necessary for interfacing with the scanning system interface module 218.

The interface and control logic module 314 contains the logic necessary for the connection and communication with the maintenance server module in the command and control center. Also within the threat scanning machine maintenance server module 216 is an operational logic module 316 that contains operational action logic and an application programming interface (API) component 318 that contains the logic necessary for interfacing with the scanning system interface module 218.

An exemplary embodiment of the scanning system interface module 218 is shown in FIG. 3. In particular, the scanning system interface module 218 may contain one or more modules 320. These modules 320 may provide interface logic necessary for the management system interface module 220 to be interconnected with and/or to control the scanning system 204. The modules 320 may, for example, provide user interface functionality to the threat scanning machine 106 operator. In another exemplary embodiment of the invention, the operator interface module 320 may reside-within the management system interface module 220. Examples of interface modules 320 include weapons processing, explosive processing, data archiving, diagnostics, image capture, material movement system, and/or the like. In addition, the scanning system interface module 218 also may contain a low-level driver module 334 adapted to directly control the circuitry, software, and/or mechanics of the scanning system 204. It should be appreciated that the threat scanning machine 106 shown in FIG. 3 is an exemplary embodiment shown for illustration purposes, and any threat scanning machine can be utilized within the threat scanning machine management system 100 with equal success. The exact software component configuration of a particular threat scanning machine 106 will depend on its contemplated use and the capabilities of its subsystems, in accordance with the present invention.

Figure 4:
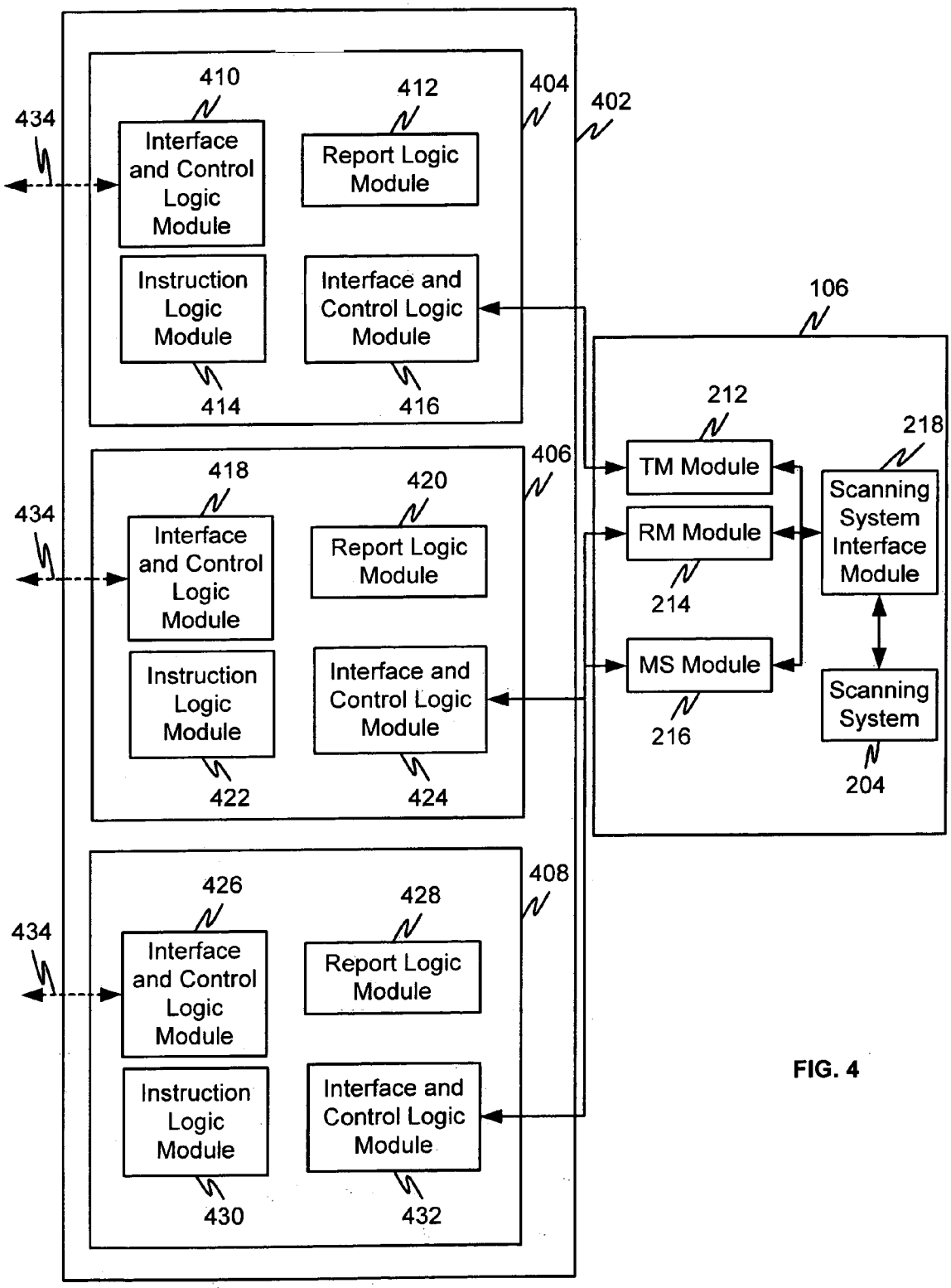
FIG. 4 is a functional block diagram of an exemplary embodiment of a threat scanning machine management system showing the details of an exemplary control center in accordance with the present invention.

FIG. 4 is a functional block diagram of an exemplary embodiment of the control center computer side of an exemplary threat scanning machine management system 100. In particular, the command and control center software 402 comprises, in addition to standard control center software components, a threat management module 404, a remote management module 406, and a maintenance server module 408.

The threat management module 404 comprises a interface and control logic module 410, a report logic module 412, an instruction logic module 414, and a threat scanning machine receive and control logic module 416.

The remote management module 406 comprises an interface and control logic module 418, a report logic module 420, an instruction logic module 422, and a threat scanning machine receive and control logic module 424.

The maintenance server module 408 comprises an interface and control logic module 426, a report logic module 428, an instruction logic module 430, and a threat scanning machine receive and control logic module 432. In an exemplary embodiment, the interface and control logic modules (302, 308, and 314) of the threat scanning machine 106 may be similar to the interface and control logic modules (410, 418, and 426) of the command and control center 110.

Figure 5:
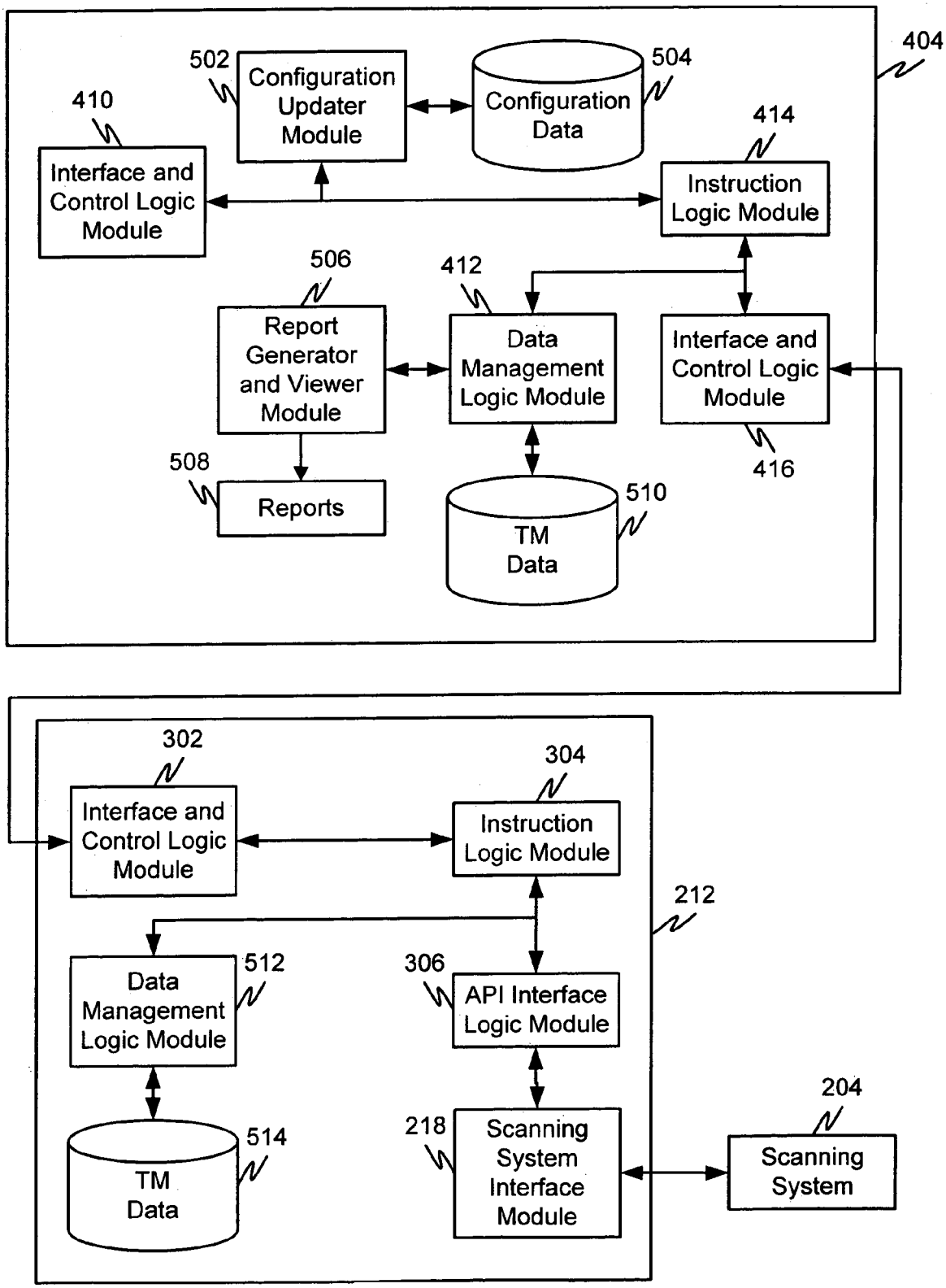
FIG. 5 is a functional block diagram of an exemplary embodiment of the logical functions of an exemplary threat management module in accordance with the present invention.

FIG. 5 is a functional block diagram of an exemplary embodiment of a threat management module in accordance with the present invention. In particular, a command and control center threat management module 404 is shown connected to a threat scanning machine threat management module 212. The command and control center threat management module 404 comprises an interface and control logic module 410, a configuration updater 502, a configuration database 504, a report generator and viewer module 506, one or more reports 508, an instruction logic module 414, a data management logic module 412, threat management database 510 and interface and control logic module 416. The threat scanning machine threat management module 212 comprises an interface and control logic module 302, an instruction logic module 304, a data management logic module 512, a threat management database 514, an API interface logic module 306, and a scanning system interface module 218.

Figure 6:
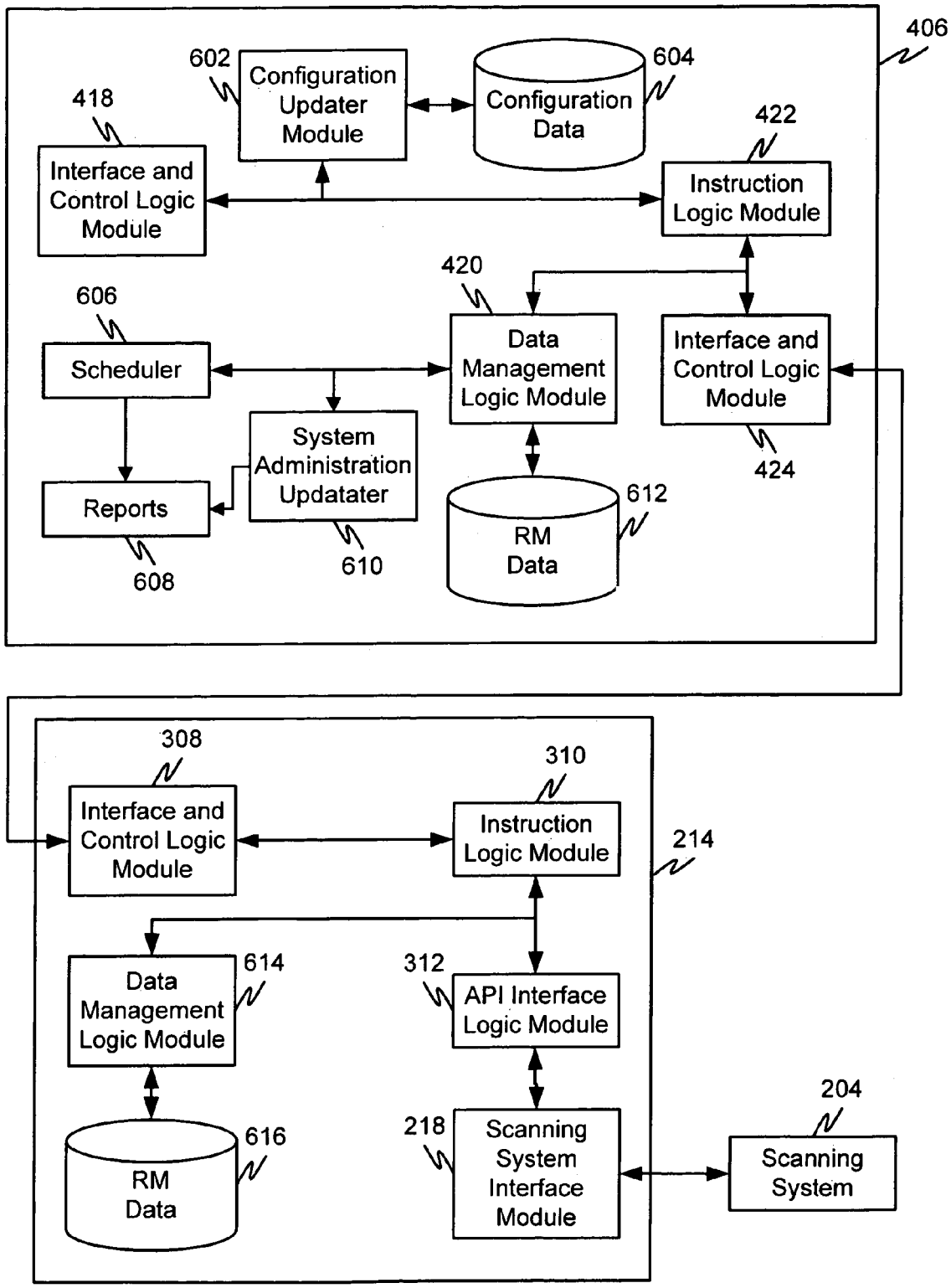
FIG. 6 is a functional block diagram of an exemplary embodiment of a remote management module in accordance with the present invention.

FIG. 6 is a functional block diagram of an exemplary embodiment of a remote management module in accordance with the present invention. In particular, a command and control center remote management module 406 is shown connected to a threat scanning machine remote management module 214. The command and control center remote management module 406 comprises an interface and control logic module 418, a configuration updater 602, a configuration database 604, a scheduler 606, a system administration updater 61 0, one or more reports 608, an instruction logic module 422, a data management logic module 420, remote management database 612 and interface and control logic module 424. The threat scanning machine remote management module 214 comprises an interface and control logic module 308, an instruction logic module 310, a data management logic module 614, a remote management database 616, an API interface logic module 312, and a scanning system interface module 218.

Figure 7:
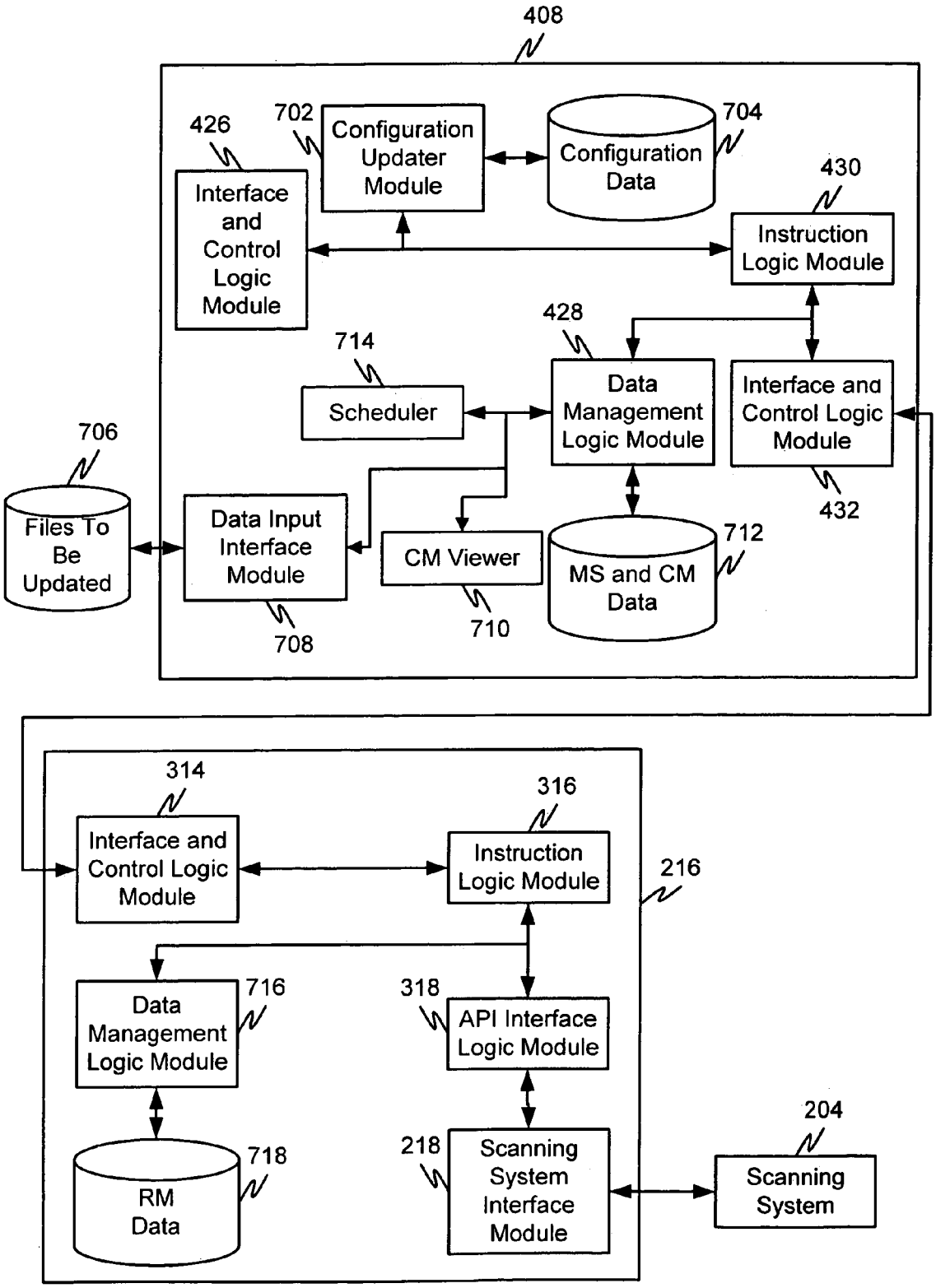
FIG. 7 is a functional block diagram of an exemplary embodiment of a maintenance server module in accordance with the present invention.

FIG. 7 is a functional block diagram of an exemplary embodiment of a maintenance server module in accordance with the present invention. In particular, a command and control center maintenance server module 408 is shown connected to a threat scanning machine maintenance server module 216. The command and control center maintenance server module 408 comprises an interface and control logic module 426, a configuration updater 702, a configuration database 704, a configuration management viewer 710, a data input interface 708, one or more data files 706, an instruction logic module 430, a data management logic module 428, maintenance server and configuration database 712, a scheduler module 714 and an interface and control logic module 432. The threat scanning machine threat management module 216 comprises an interface and control logic module 314, an instruction logic module 316, a data management logic module 716, a maintenance server database 718, an API interface logic module 318 and a scanning system interface module 218.

Figure 8:
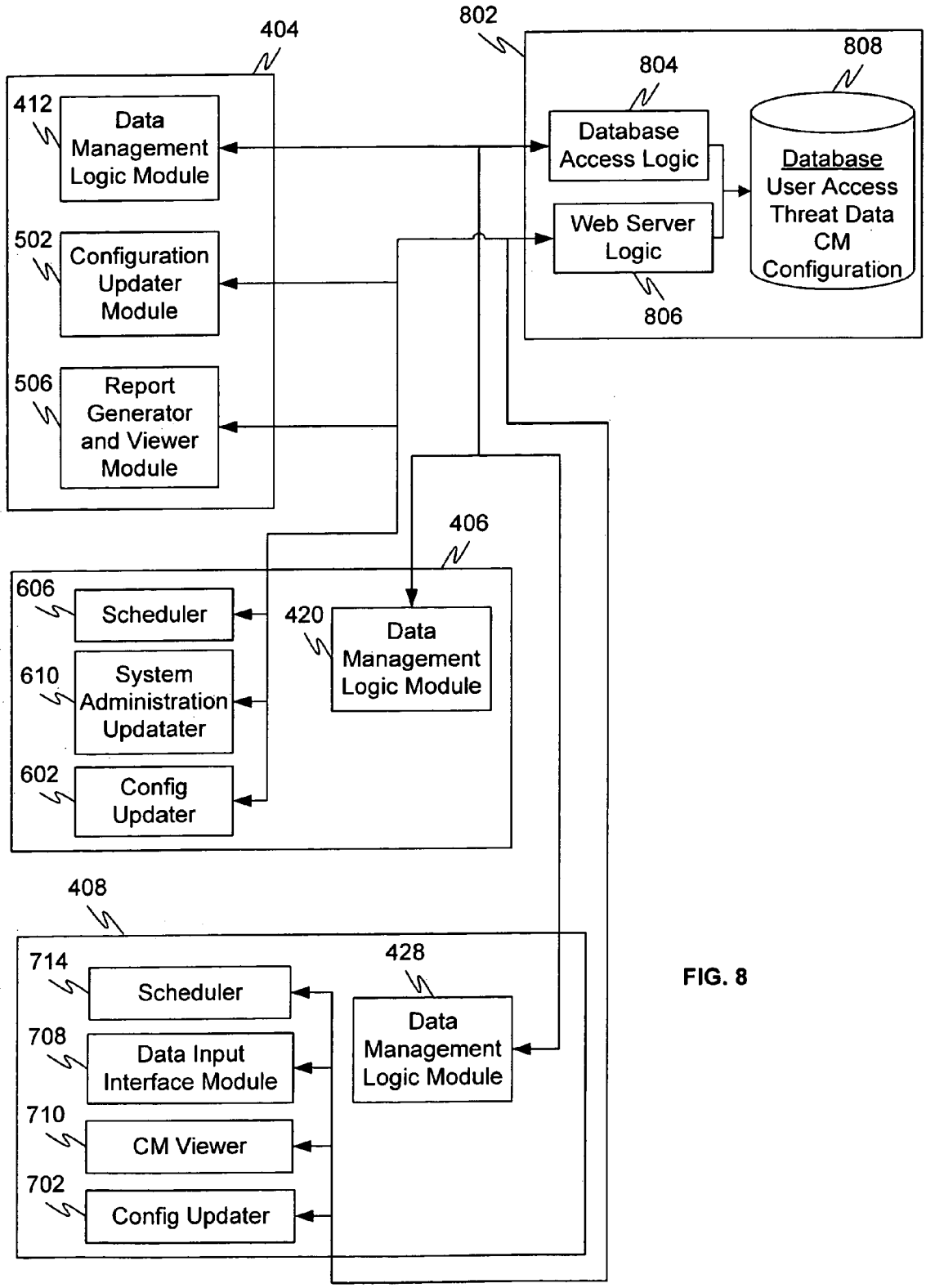
FIG. 8 is a functional block diagram of an exemplary embodiment of a control center database and web service connections in accordance with the present invention.

FIG. 8 is a functional block diagram of an exemplary embodiment of a control center database and web service connections in accordance with the present invention. In particular, the threat scanning machine management system 100 data store 802 comprises a database access logic module 804, a web server logic module 806 and a database 808. The data management logic modules 412, 420, and 428 of the threat management, remote management, and maintenance server modules, respectively, are connected to the database access logic module 804. The report generator and viewer 506 and the configuration updater 502 of the threat management module 404 are connected to the web server logic module 806. The system administration updater 610, the scheduler 606 and the configuration updater 602 of the remote management module 406 are connected to the web server logic module 806. The configuration management viewer 710, the scheduler 714, the data input interface 708 and the configuration updater 702 of the maintenance server 408 are connected to web server logic module 806. The web server logic module 806 is connected to the database 808.

In operation, the data management logic modules 412, 420, and 428 of the threat management, remote management, and maintenance server modules respectively communicate with the database access logic module 804. The database access logic module provides the interface connectivity to the database 808. The web server logic module 806 provides the command and control center with web service access to the database 808.

Figure 9:
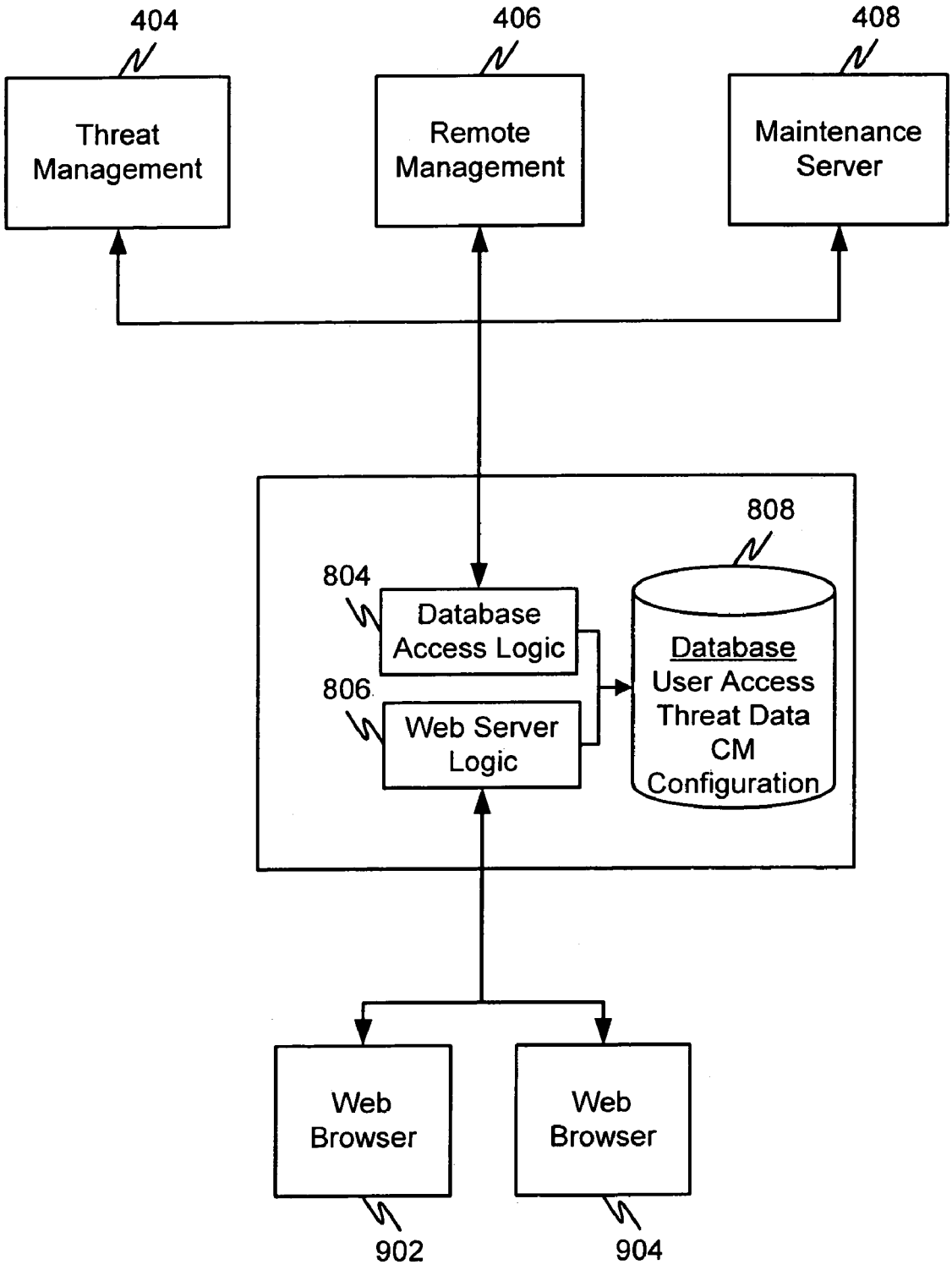
FIG. 9 is a functional block diagram of an exemplary control and maintenance system showing a web browser connection in accordance with the present invention.

FIG. 9 is a functional block diagram of an exemplary control and maintenance system showing a web browser connection in accordance with the present invention. In particular, web browsers 902 and 904 are shown connected to the web server logic module 806. While two web browsers are shown, it should be appreciated that multiple web browsers may connect to the web server logic module 806.

Figure 10:
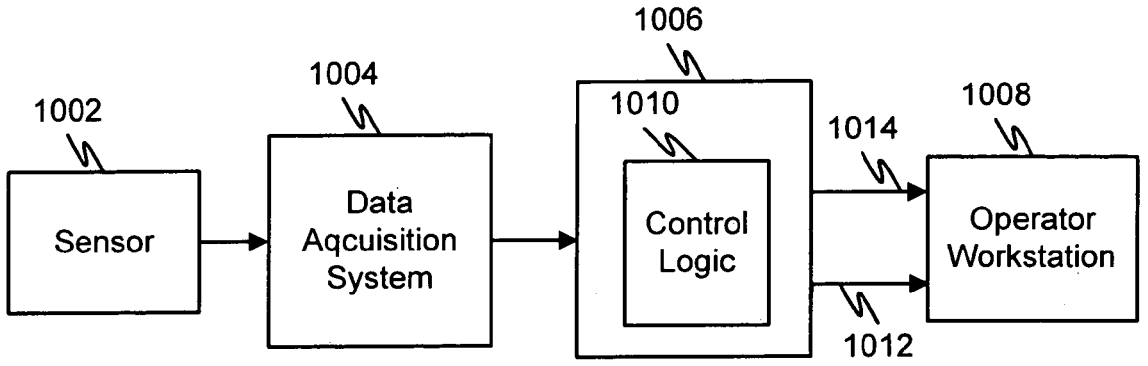
FIG. 10 is a functional block diagram of an exemplary threat scanning machine architecture in accordance with the present invention.

FIG. 10 is a functional block diagram of an exemplary threat scanning machine architecture. In particular, the threat scanning machine comprises a sensor 1002, a data acquisition system 1004, a reconstruction computer 1006, and an operator workstation 1008. The reconstruction computer 1006 comprises a control logic module 1010. The operator workstation 1008 presents a graphical user interface to the operator of the threat scanning machine.

In operation, raw data from the sensor 1002 is collected by the data acquisition system 1004. The raw data is then transmitted to the reconstruction computer 1006. The reconstruction computer 1006 processes the raw data and may provide a three-dimensional image 1014 or a two-dimensional image 1012 to the operator workstation 1008. In a threat scanning machine adapted for use with the threat scanning machine management system 100, the software for the threat scanning machine management system 100 resides on the operator workstation 1008. The threat scanning machine management system 100 can download software or data to the reconstruction computer 1006, operator workstation 1008, and/or other components of the threat scanning machine that may require software or data to operate.

Figure 11:
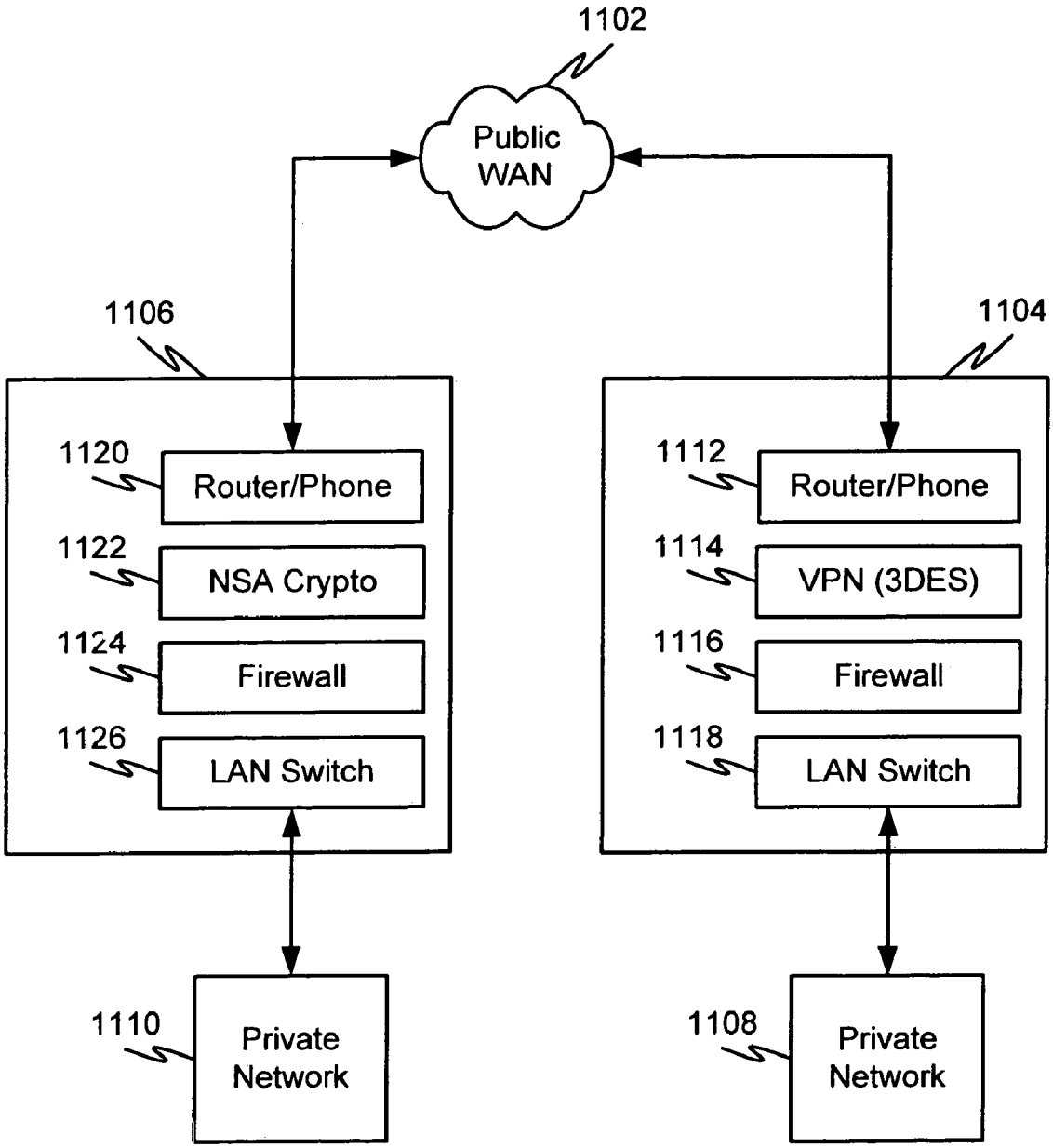
FIG. 11 is a functional block diagram of an exemplary embodiment of the threat scanning machine management system showing an exemplary approach to network security in accordance with the present invention.

FIG. 11 is a functional block diagram of an exemplary embodiment of the threat scanning machine management system showing an exemplary approach to network security for two different levels of security, confidential and secret. In particular, the public network 1102, for example a wide area network (WAN), is connected to both a confidential communications system 1104 and a secret communications system 1106. The confidential communications system comprises a router 1112, a triple data encryption standard (3DES) virtual private network connection 1114, a firewall 1116 and a local area network (LAN) switch 1118. An exemplary private network 1108 is connected to the LAN switch 1118. The secret communications system 1106 comprises a router 1120, a National Security Agency (NSA) cryptographic processor 1122, a firewall 1124, and a LAN switch 1126. A private network 1110 is connected to the LAN switch 1126.

Figure 12:
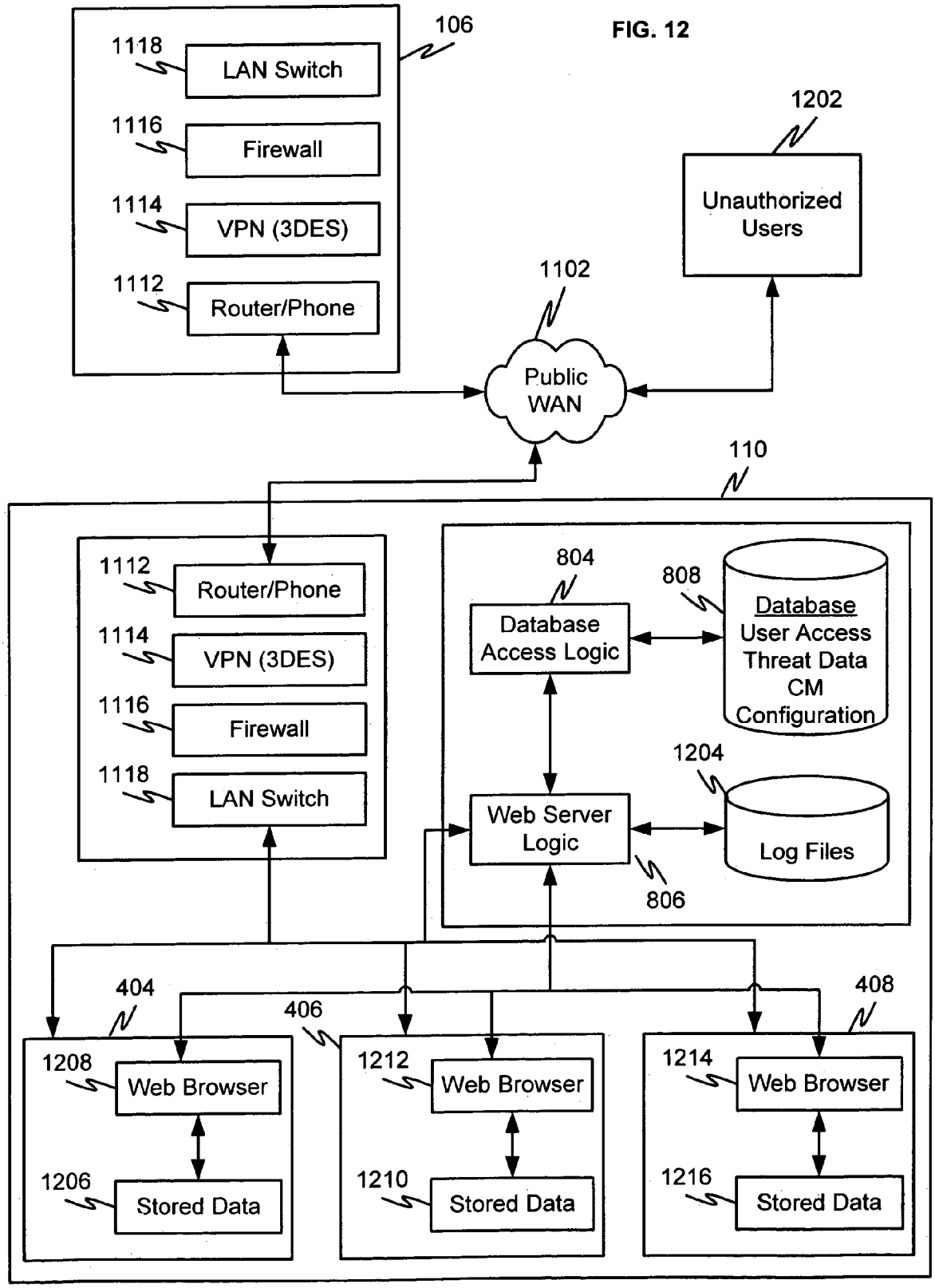
FIG. 12 is a functional block diagram of an exemplary embodiment of the threat scanning machine management system showing exemplary security components in accordance with the present invention.

FIG. 12 is a functional block diagram of an exemplary embodiment of the threat scanning machine management system showing exemplary security components in accordance with the present invention. In particular, a threat scanning machine 106 is connected to the public wide area network (WAN) 1102. A command and control center 110 is also connected to the public WAN 1102. Unauthorized users 1202 may be connected to the public wide area network. The threat scanning machine communications system comprises a router/phone 1112, an encryption module 1114 or 1120 depending on the level of security, a firewall 1116, and a local area network (LAN) switch 1118. The command and control center 110 comprises a threat management module 404, a remote management module 406, a maintenance server module 408, a web server logic module 806, log files 1204, a database 808, a router/phone 1112, an encryption device 1114 or 1120 depending on the level of security required, a firewall 1116 and a LAN switch 1118.

In operation, the unauthorized users 1202 are restricted from accessing the threat scanning machine 106 or the command and control center 110. While the encryption devices 1114 or 1120, permit the threat scanning machine 106 and the command and control center 110 to communicate in a secure manner.

Figure 13A:
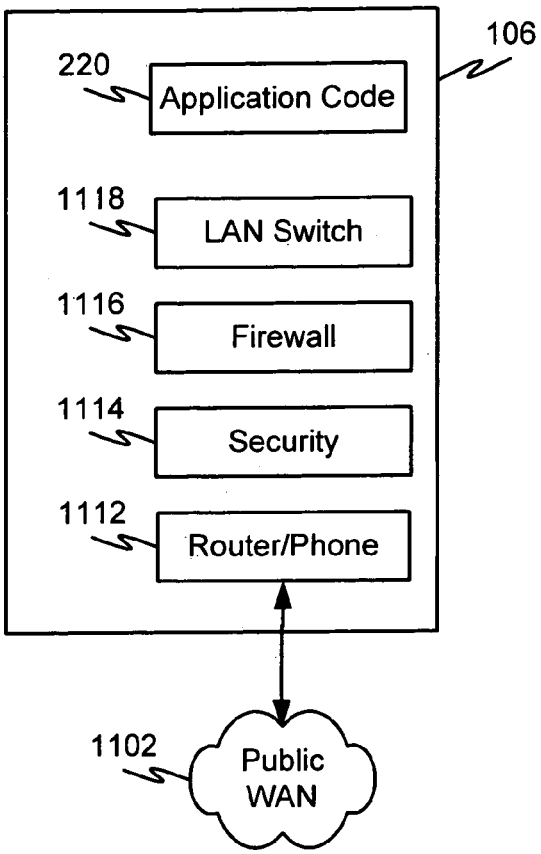
FIGS. 13A and 13B are functional block diagrams of exemplary embodiments of the threat scanning machine management system showing exemplary alternative approaches to the network connection of security equipment in accordance with the present invention.
Figure 13B:
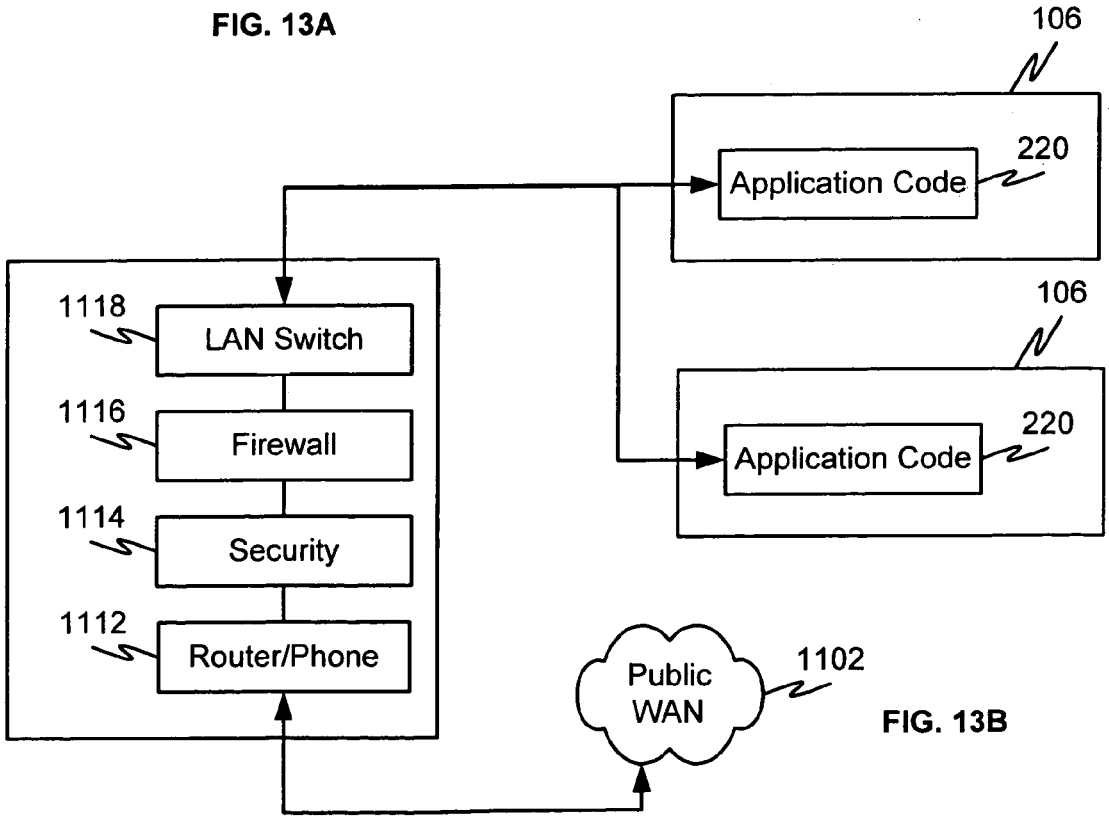

FIG. 13 is a functional block diagram of an exemplary embodiment of the threat scanning machine management system showing exemplary alternative approaches to the network connection of security equipment in accordance with the present invention. In particular, FIG. 13 shows two approaches to network security within a transportation facility. In FIG. 13A, the threat scanning machine 106 requires the security hardware and software to be present within the threat scanning machine. In FIG. 13B, there is one set of security hardware and software for an entire facility and the threat scanning machines 106 are all interconnected to the one set of communications security hardware and software.

In FIG. 13A, the threat scanning machine comprises application code 220, a local area network switch 1118, a firewall 1116, an encryption device 1114 or 1120 depending on the level of security required, and a router/phone 1112. In operation the threat scanning machine 106 containing its own set of communications security hardware and software is able to be directly connected to the public wide area network 1102.

In FIG. 13B, the communications security hardware and software may be placed in a central location and accessed by one or more threat scanning machines 106. The communications equipment comprises a local area network switch 1118, a firewall 1116, an encryption device 1114 or 1120 depending on the level of security required, and a router/phone 111 2. The threat scanning machines 106 each contain their own application code 220. The threat scanning machines 106 are interconnected to the communications security equipment via the LAN switch 1118.

In operation, each threat scanning machine 106 communicates through the LAN switch 1118 to the communications security hardware and software in order to access the public wide area network 1102.

Figure 14:
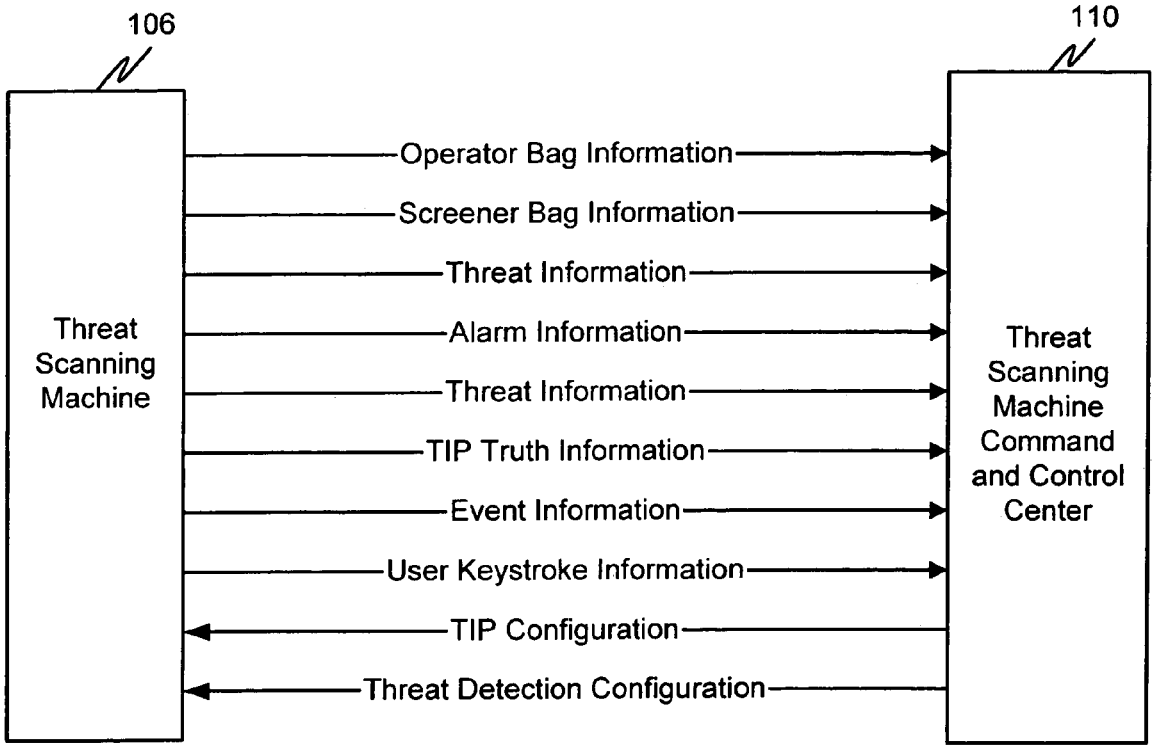
FIG. 14 is a functional block diagram of an exemplary message interface between a threat scanning machine and the threat scanning machine management system in accordance with the present invention.

FIG. 14 shows a functional block diagram of a threat scanning machine 106 interconnected with a command and control center 110. In particular, FIG. 14 shows an exemplary message interface between the threat scanning machine 106 and the command and control center 110 in accordance with the messages described in Tables 1 through 7 above.

In operation, the threat scanning machine 106 provides the following message to the command and control center 110: operator bag information, the screener bag information, the threat information, alarm information, TIP truth information, event information, and user keystroke information. The command and control center 110 provides the following messages to the threat scanning machine 106, TIP configuration and threat detection configuration.

One way that the personnel using a threat scanning machine management system can interact with the system is through computer adapted to provide a graphical user interface. The following is a description of an exemplary graphical user interface in accordance with the present invention. However, it should be appreciated that the graphical user interface shown in the figures is provided for illustrative purposes. A particular embodiment of the invention may have a graphical user interface that is implemented, configured, or adapted differently depending on the contemplated uses of the invention.

Figure 15:
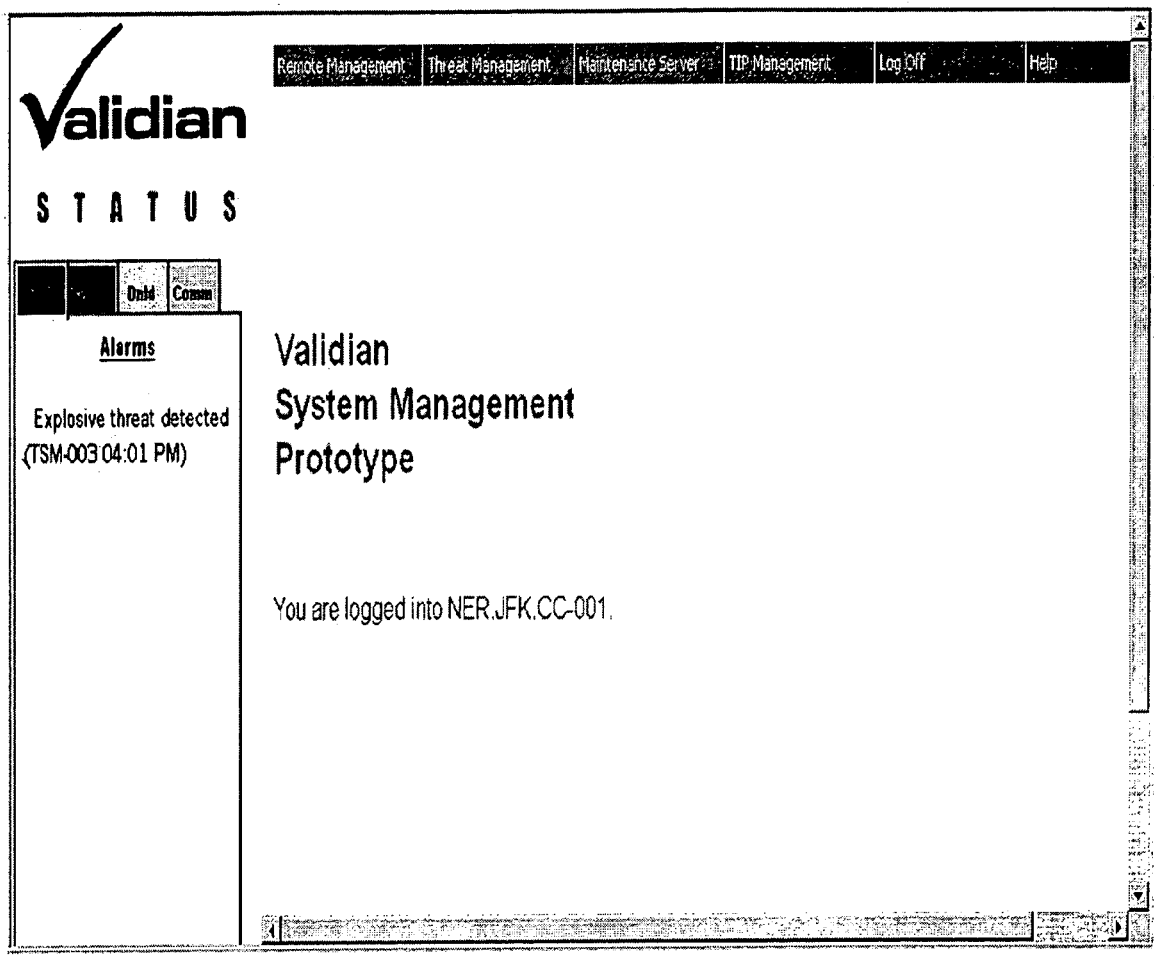
FIG. 15 is an illustration of an exemplary embodiment of the threat scanning machine management system user interface showing the main menu screen.

FIG. 15 is an illustration of an exemplary user interface for the threat scanning machine management system showing the main menu screen. In particular, the main menu comprises Remote Management, Threat Management, Maintenance Server, TIP Management, Log Off, and Help choices. There is also shown in FIG. 15 a tab style user interface element comprises the tabs choices of Alarms, Events, DnId (an abbreviation for download), and Comm (an abbreviation for communications).

Figure 16:
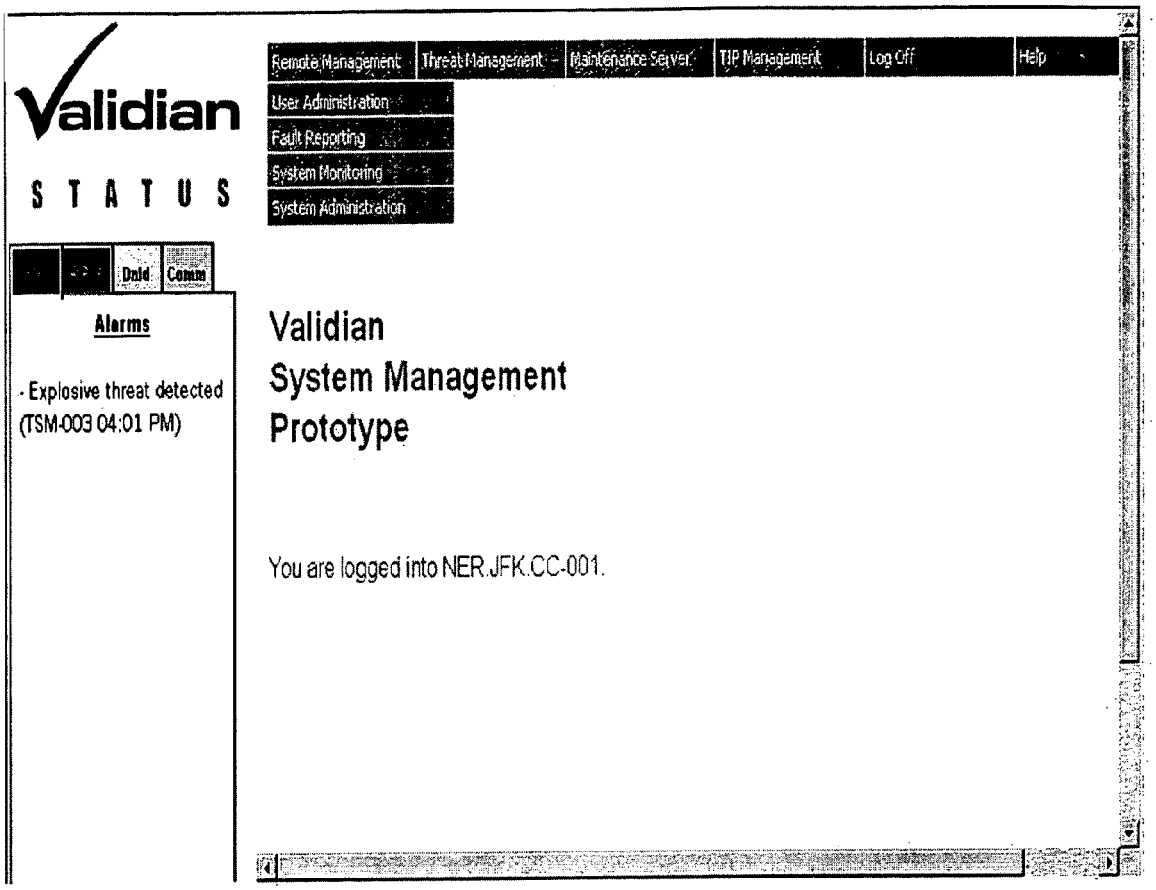
FIG. 16 is an illustration of an exemplary embodiment of the threat scanning machine management system user interface showing the items of the Remote Management menu.

If the user selects the Remote Management menu choice, the Remote. Management menu will be displayed. FIG. 16 is an illustration of an exemplary user interface for the threat scanning machine management system showing the items available under the Remote Management menu choice. In particular, the Remote Management menu comprises User Administration, Fault Reporting, System Monitoring, and System Administration choices.

Figure 17:
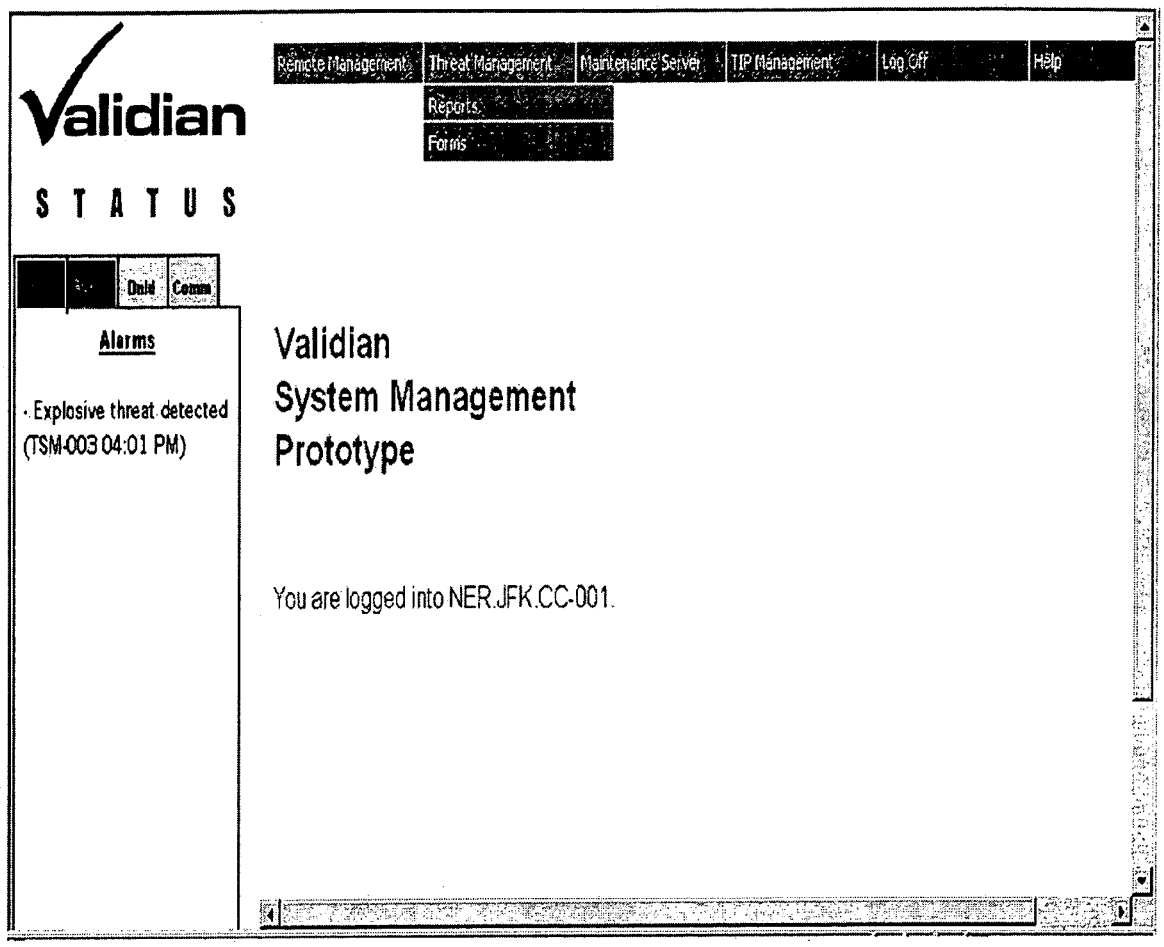
FIG. 17 is an illustration of an exemplary embodiment of the threat scanning machine management system user interface showing the items of the Threat Management menu.

If the user selects, from the main menu, the Threat Management menu choice, the Threat. Management Menu will be displayed. FIG. 17 is an illustration of an exemplary user interface for the threat scanning machine management system showing the items available under the Threat Management menu choice. In particular, the Threat Management menu comprises Reports and Forms menu choices.

Figure 18:
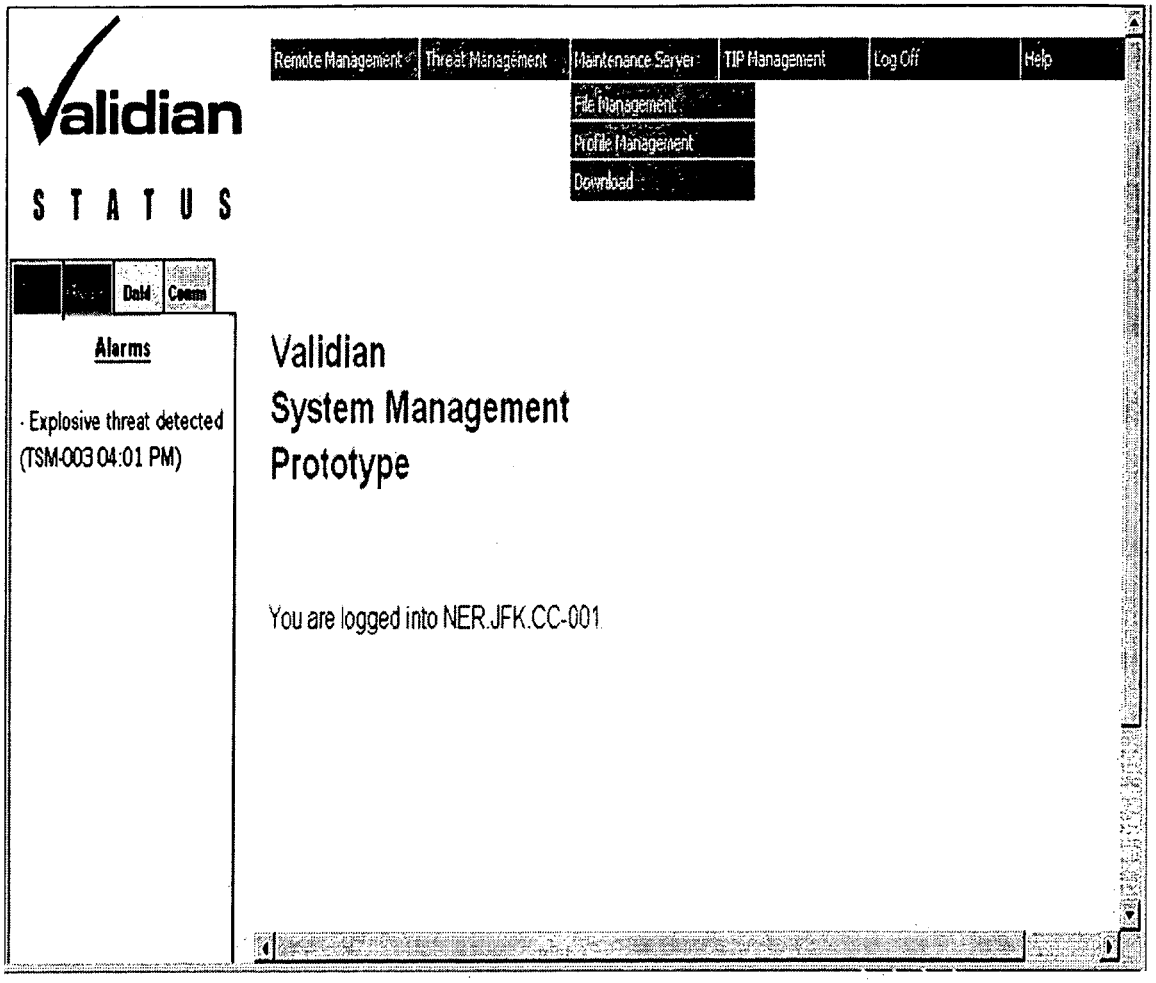
FIG. 18 is an illustration of an exemplary embodiment of the threat scanning machine management system user interface showing the items of the Maintenance Server menu.

If the user selects, from the main menu, the Maintenance Server menu choice, the Maintenance Server menu will be displayed. FIG. 18 is an illustration of an exemplary user interface for the threat scanning machine management system showing the items available under the Maintenance Server menu choice. In particular, the Maintenance Server menu comprises File Management, Profile Management, and Download menu choices.

Figure 19:
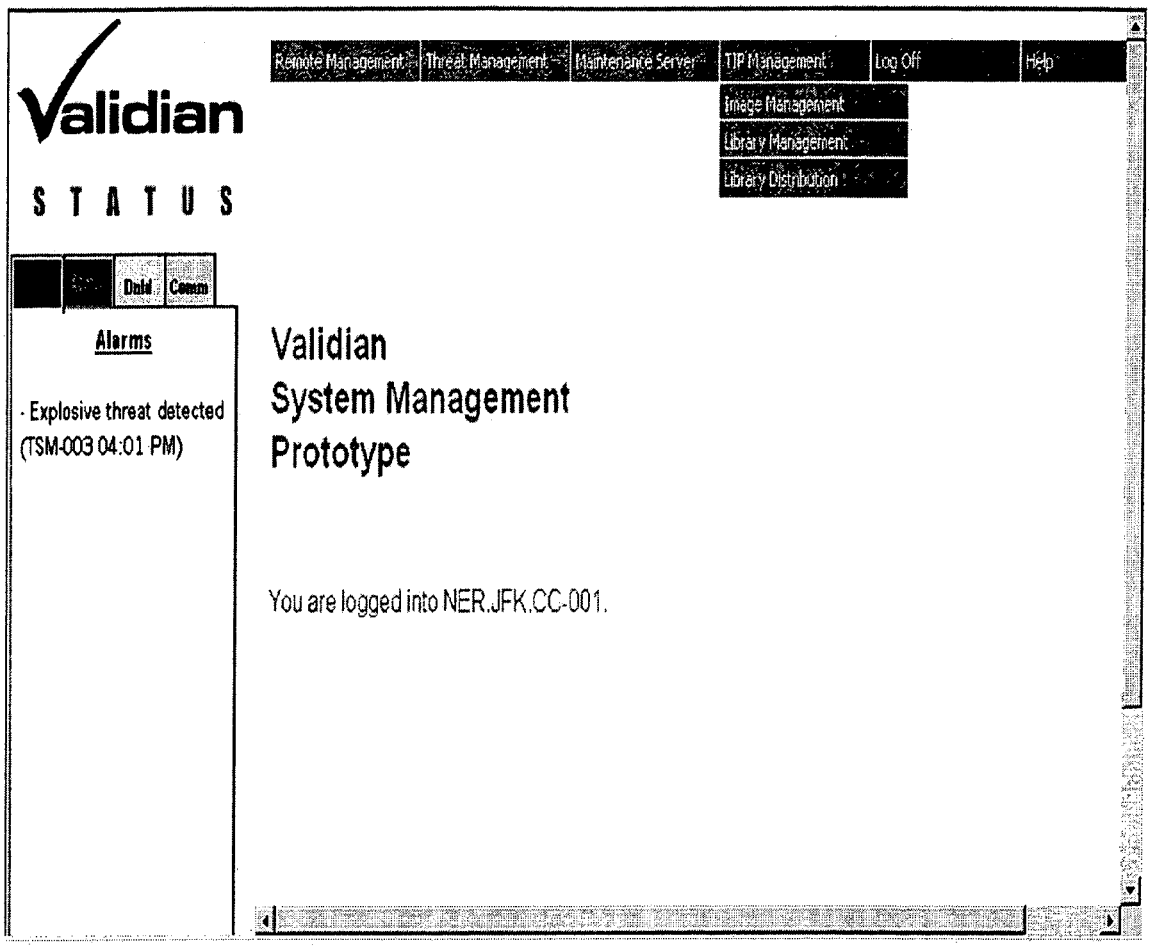
FIG. 19 is an illustration of an exemplary embodiment of the threat scanning machine management system user interface showing the items of the Threat Image Projection (TIP) Management menu.

If the user selects, from the main menu, the TIP Management menu choice, the TIP Management menu will be displayed. FIG. 19 is an illustration of an exemplary user interface for the threat scanning machine management system showing the items available under the TIP Management menu choice. In particular, the TIP management menu comprises Image Management, Library Management, and Library Distribution menu choices.

If the user sects, from the main menu, the Log Off menu choice, the user will be logged of the system.

If the user selects, from the main menu, the Help menu choice, the user will be presented with information on how to operate the threat scanning machine management system.

Figure 20:
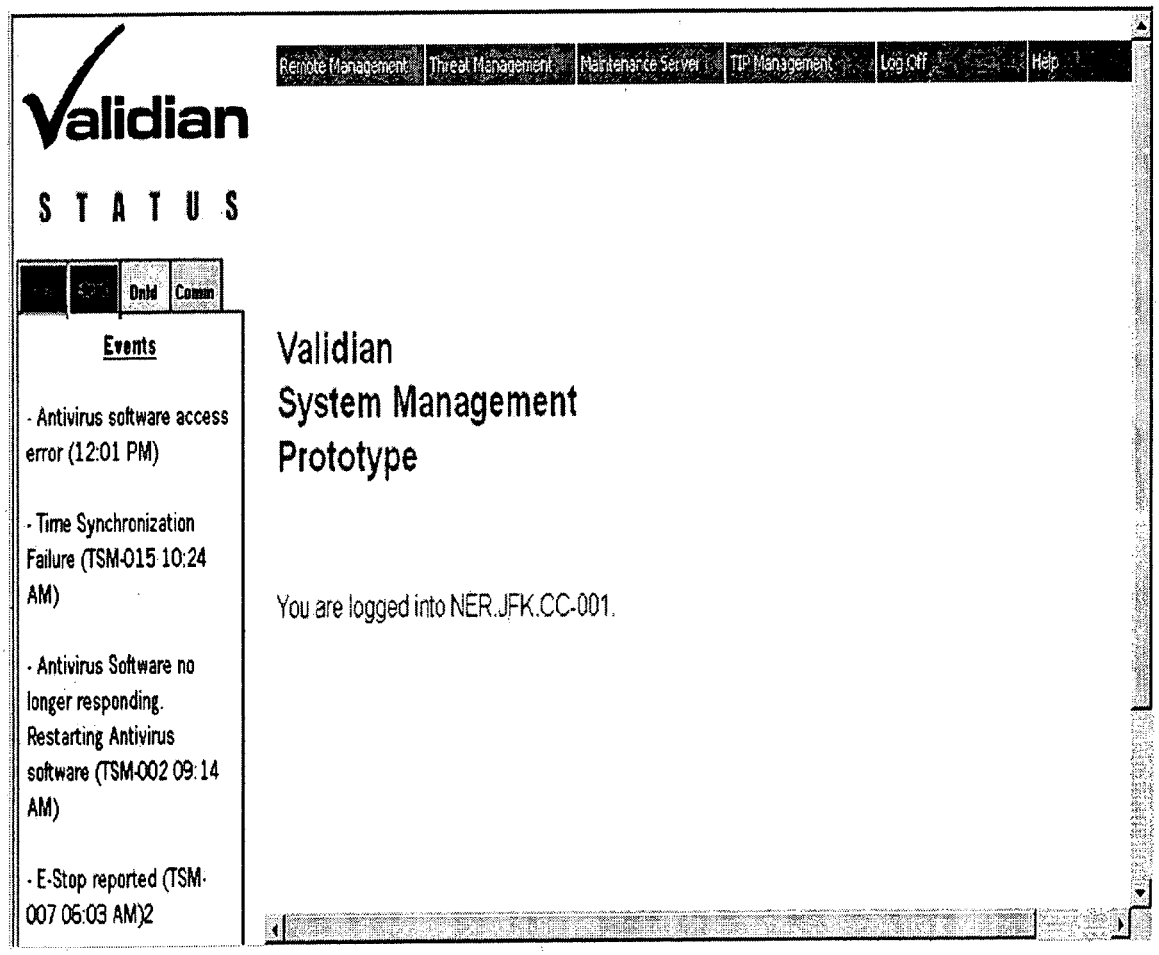
FIG. 20 is an illustration of an exemplary embodiment of the threat scanning machine management system user interface showing Event information.

FIG. 20 shows an exemplary Events tab screen. FIG. 26 shows an exemplary Comm (short for communications) tab screen. The tab screens allow the operator to quickly ascertain the status of important system functions.

Returning to the Remote Management menu of FIG. 16, if the user selects the User Administration menu choice, the User Administration screen will be displayed. FIG. 21 is an illustration of an exemplary user interface for the threat scanning machine management system showing the User Administration screen.

Figure 22:
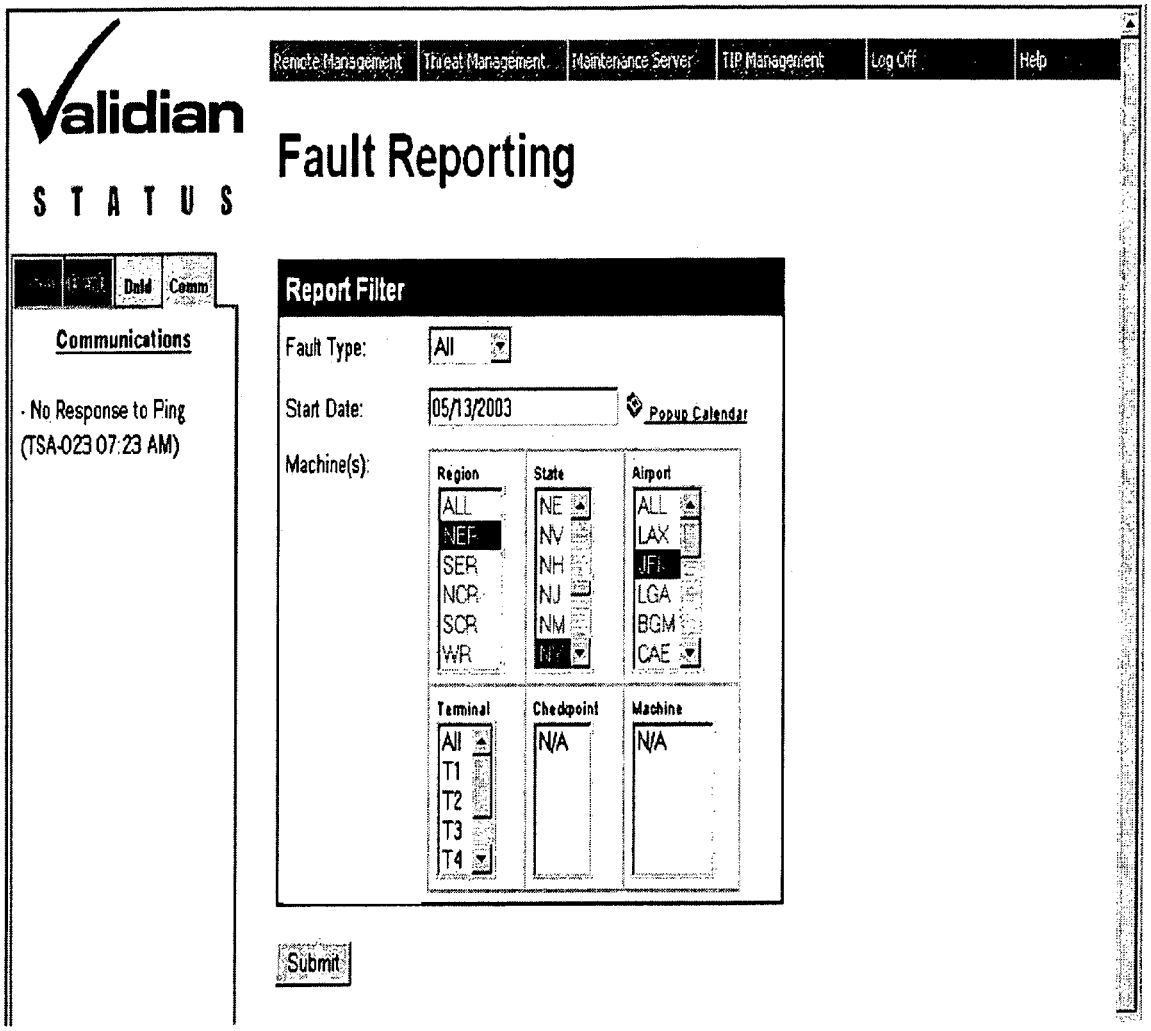
FIG. 22 is an illustration of an exemplary embodiment of the threat scanning machine management system user interface showing a Fault Reporting selection dialog.

If the users selects, from the Remote Management menu, the Fault Reporting menu choice, the Fault Reporting dialog will appear. FIG. 22 is an illustration of an exemplary user interface for the threat scanning machine management system showing the Fault Reporting selection dialog interface.

Figure 23:
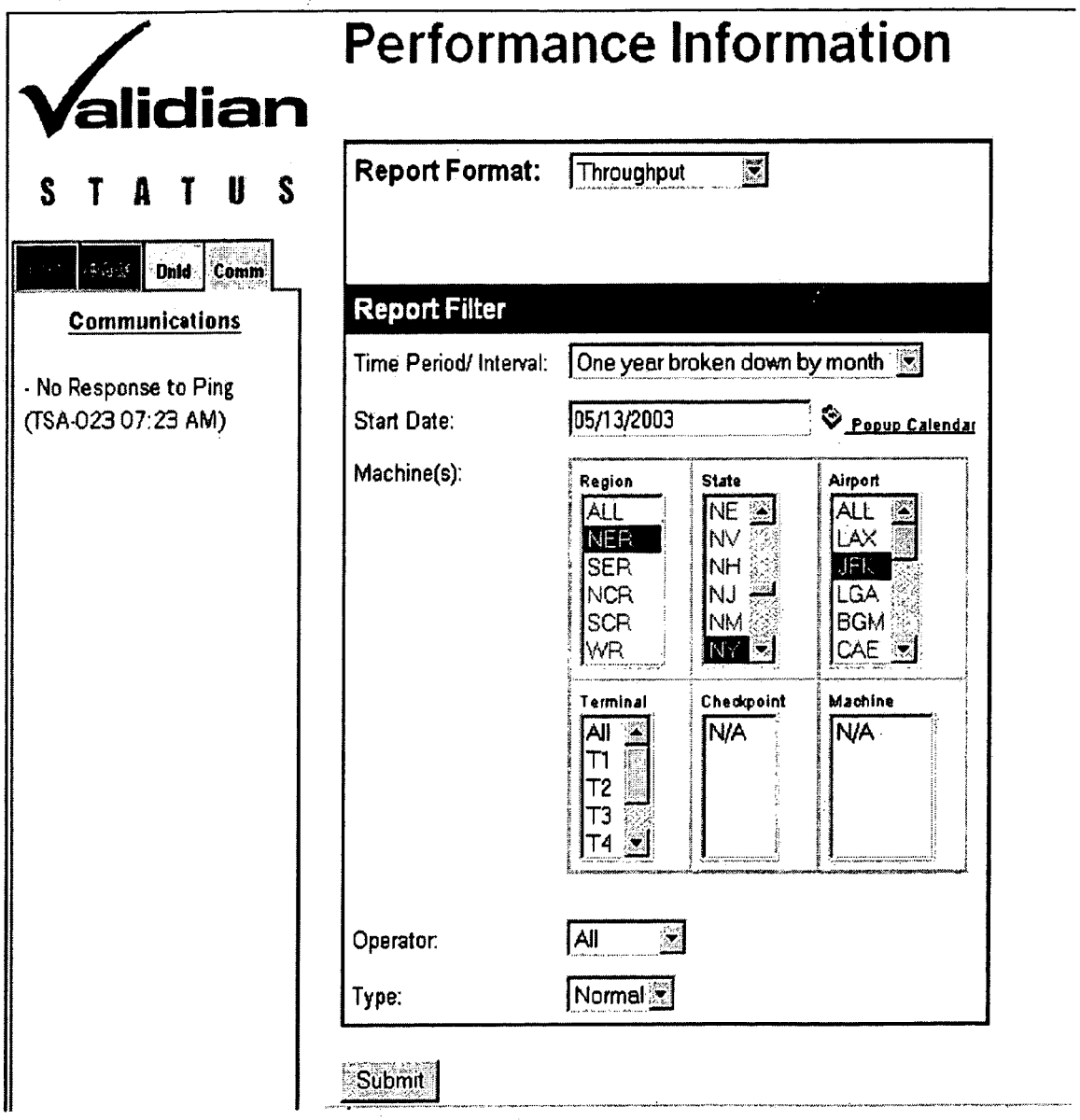
FIG. 23 is an illustration of an exemplary embodiment of the threat scanning machine management system user interface showing a Report Filter selection dialog.

If the user selects, from the Remote Management menu, the System Monitoring menu choice, the Performance Information dialog will be displayed. FIG. 23 is an illustration of an exemplary user interface for the threat scanning machine management system showing the Performance Information dialog.

If the user selects, from the Remote Management menu, the System Administration menu choice, the System Administration menu will be displayed. FIG. 24 is an illustration of an exemplary user interface for the threat scanning machine management system showing the System Administration screen.

Turning now to the Threat Management menu shown in FIG. 17, if the user selects, from the Threat Management menu, the Reports menu choice, the reports selection will be displayed. Examples of the types of reports available include the Download Schedule shown in FIG. 25, the Throughput Report shown in FIG. 27, the Personnel Report shown in FIG. 28, the Current Alarm Report shown in FIG. 29, the Historical Bag/Threat Information Report shown in FIG. 30, the Threat Type Information Report shown in FIG. 31, the Fault Report shown in FIG. 37 and the All Actions Taken Information Report shown in FIG. 32.

Turning now to the Maintenance Server menu shown in FIG. 18, if the user selects from the Maintenance Server menu, the File Management menu choice, the File Management screen will be displayed. FIG. 33 is an illustration of an exemplary user interface for the threat scanning machine management system File Management screen. From the File management screen, the user can add files.

If the user selects, from the Maintenance Server menu, the Profile Management menu choice, the Profile Management screen will be displayed. FIG. 34 is an illustration of an exemplary user interface for the threat scanning machine management system showing the Profile Management screen. From the Profile Management screen, the user can define a profile comprising one or more files that require downloading. The profile is a way of bundling the files that require downloading together.

If the user selects, from the Maintenance Server menu, the Download menu choice, the Download Management screen will be displayed. FIG. 35 is an illustration of an exemplary user interface for the threat scanning machine management system showing the Download Management screen. Using the Download Management screen, the user can schedule a download of a previously defined profile.

Turning now to the TIP Management menu shown in FIG. 19, if the user selects the Image Management option, the TIP Image Management screen will be displayed. FIG. 36 is an illustration of an exemplary user interface for the threat scanning machine management system showing the TIP Image Management screen.

Figure 37:
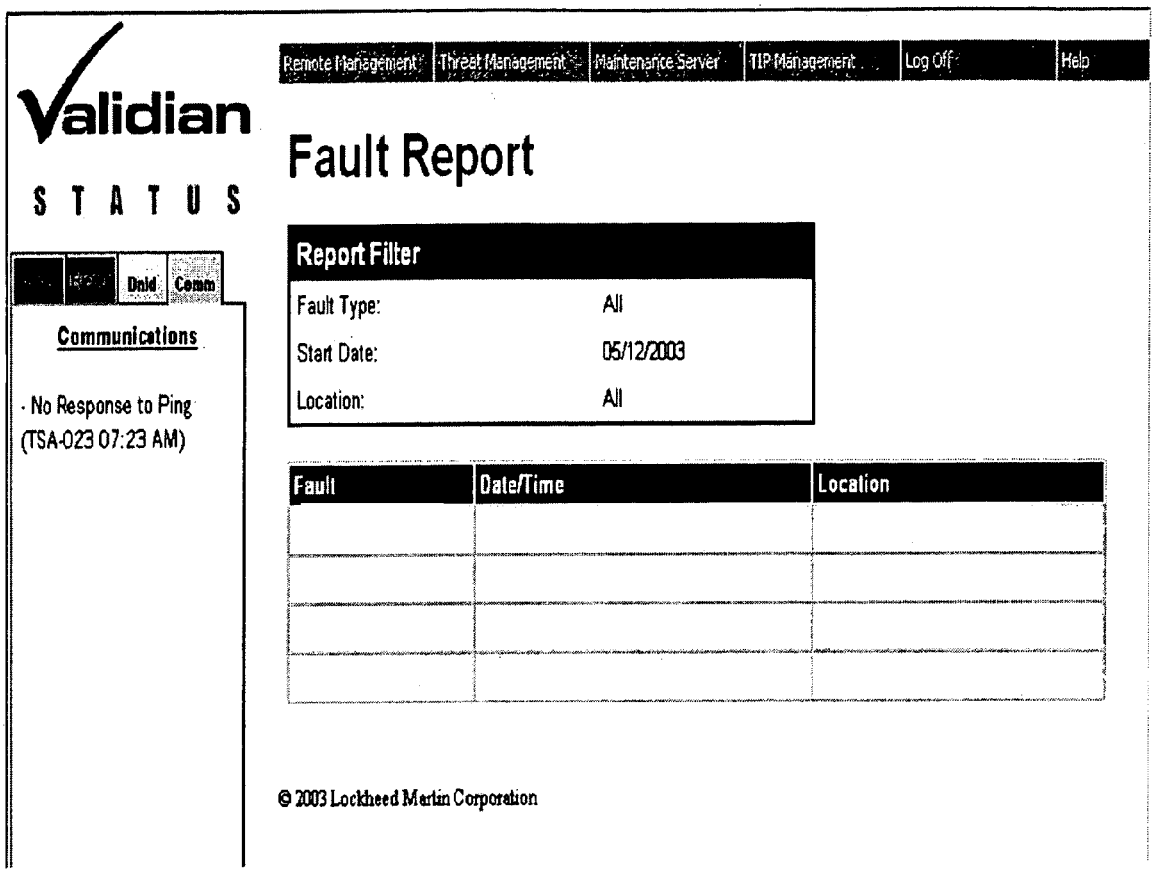
FIG. 37 is an illustration of an exemplary embodiment of the threat scanning machine management system user interface showing a Fault Report.

FIG. 37 shows an exemplary Fault Report screen. There are no faults shown in this example. However, if faults were present for the report criteria specified, such faults would be displayed in the table along with the pertinent fault details.

Figure 38:
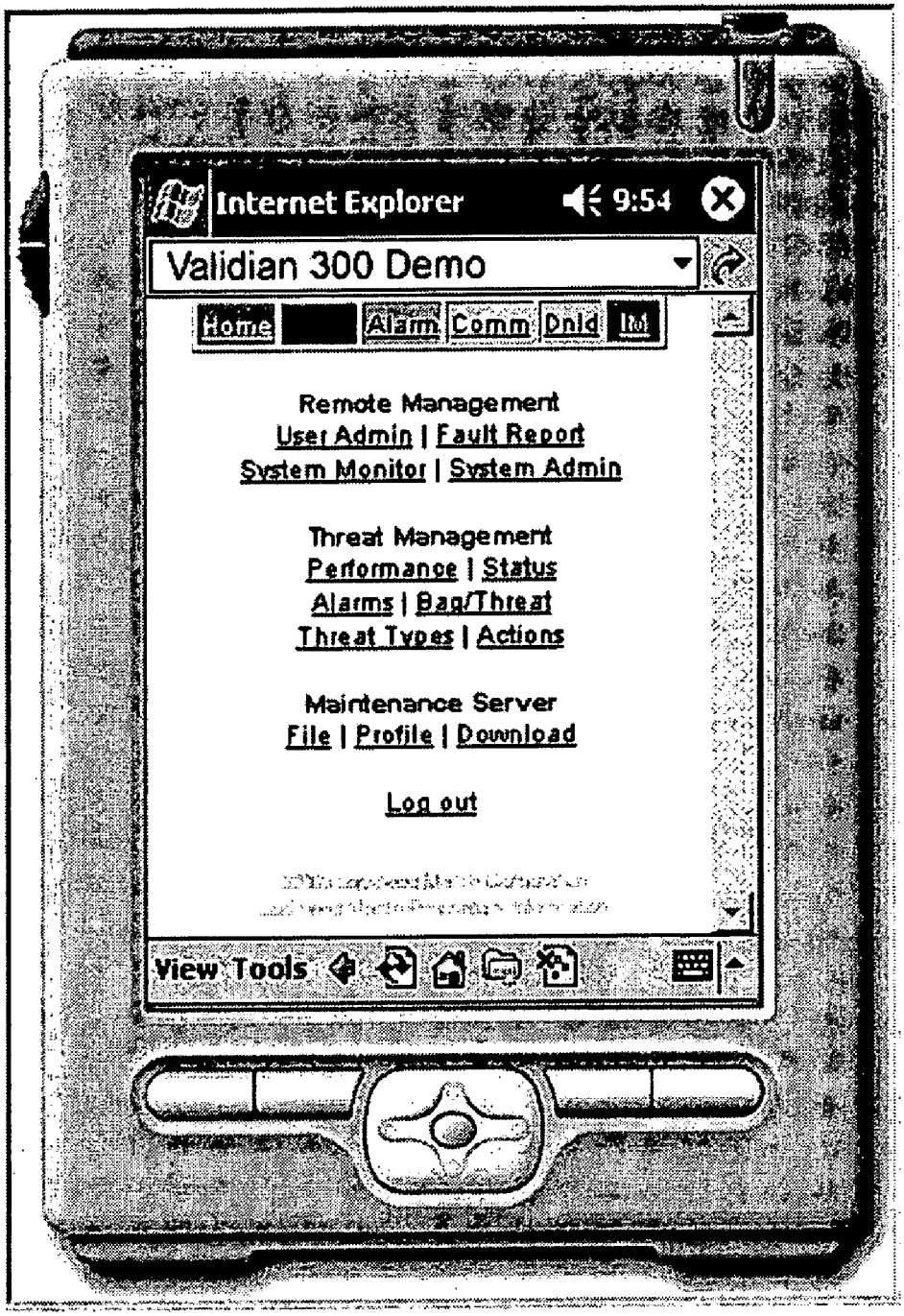
FIG. 38 is an illustration of an exemplary embodiment of the threat scanning machine management system user interface adapted for use on a handheld or portable computer showing the main menu screen.

FIG. 38 shows an exemplary threat scanning machine management system user interface that has been adapted to be displayed on a handheld computer, laptop computer, or the like. In particular, FIG. 38 is presented to show the main menu screen on a simulated handheld device. While the other screens are not shown on a handheld device is should be appreciated that the entire threat management system user interface may be adapted to use on handheld computer, laptop computer, portable computer, network enabled communications device, or any type of portable computing device.

The unique architecture of the threat scanning management system 100 allows the expansion of its capability beyond that already discussed. In particular, the horizontal and vertical architecture of the threat scanning machine management system 100 lends itself to easy management and the cross-integration of information from a plurality of sources. While the embodiments discussed hereinafter will be described as integrated with the threat scanning machine management system 100, it is to be appreciated that the passenger and item tracking with predictive analysis can be used as an independent architecture and methodology.

Figure 39:
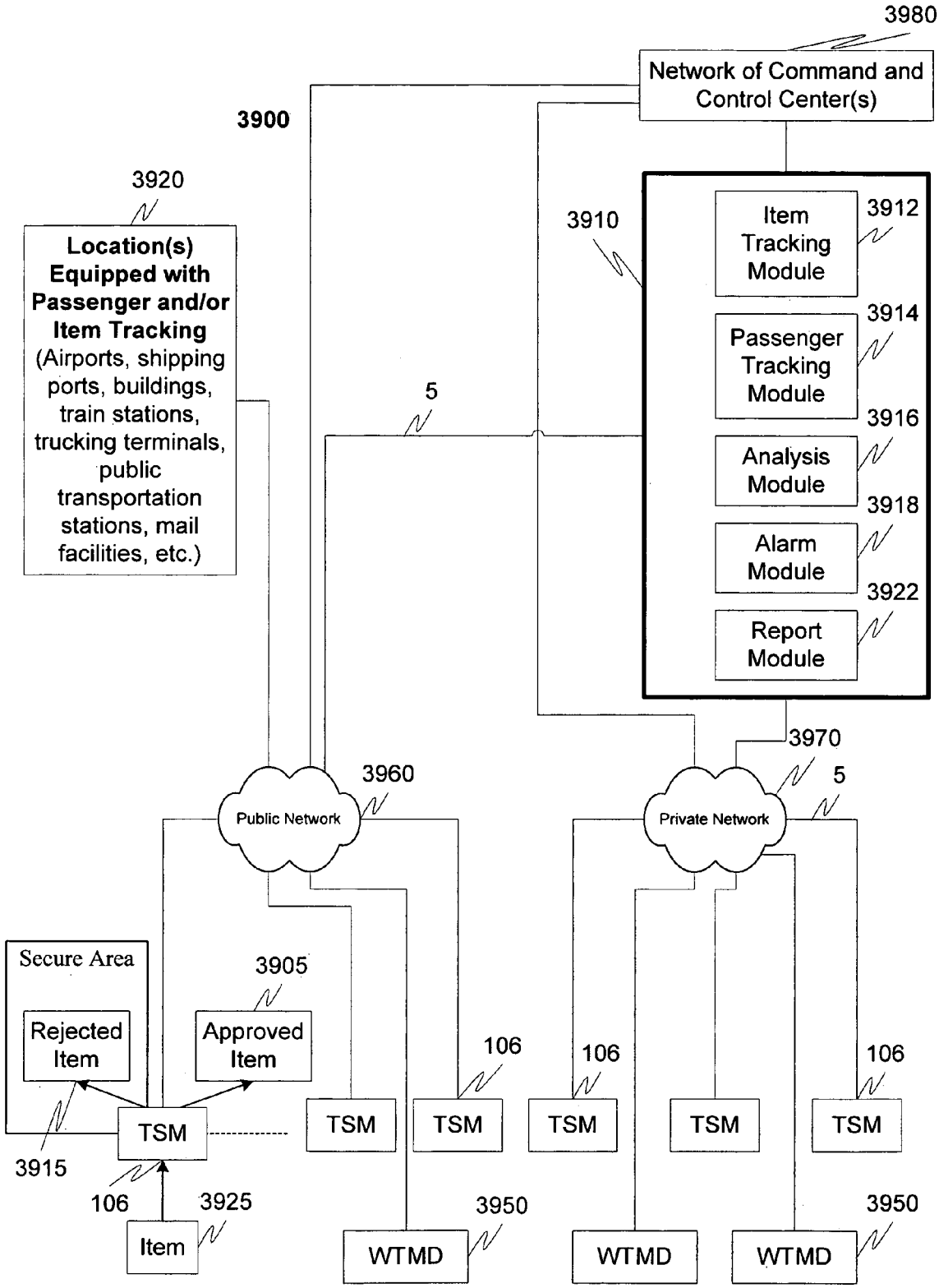
FIG. 39 is a functional block diagram illustrating an exemplary embodiment of the passenger and item tracking according to this invention.

Passenger and item tracking with predictive analysis is illustrated in FIG. 39. The system includes a tracking and analysis module 3910, which includes an item tracking module 3912, a passenger tracking module 3914, an analysis module 3916, an alarm module 3918, and a report module 3922. The tracking and analysis module 3910 is connected to one or more command and control centers within the network of command and control centers 3980 (illustrated in FIG. 1). Both of the tracking and analysis module 3910 and the command and control centers can be directly or indirectly connected to one or more of a public network 3960 and private network 3970, which are in turn connected to one or more threat scanning machines 106, walk through metal detectors (WTMD) 3950, or, in general, any equipment, information acquisition and/or data entry system that can be used to receive information that can be utilized to track one or more of items and passengers.

As with the threat scanning machine management system 100, the tracking and analysis module 3910 can be replicated in a hierarchical manner with, for example, a first level tracking and analysis module 3910 that cooperates with a next higher level tracking and analysis module 3910 that may, for example, be associated with another command and control center within the network of command and control centers 3980. For example, as illustrated by the one or more locations equipped with passenger and/or item tracking 3920, a tracking and analysis module 3910 can be associated with a plurality of different locations, with the tracking and analysis module 3910 capable of being collocated or non-collocated with those locations. Through this type of architecture, it is possible to create a network of tracking and analysis modules that have the capability of monitoring items and/or passengers at a plurality of different locations, nationally or internationally to provide more comprehensive protection and safety.

It may also be desirable to restrict the tracking and analysis module 3910 to only communicate with a plurality of equipment, information acquisition and/or data entry system(s) that can be used to receive information that can be utilized to track one or more of items and passengers. As such, the tracking and analysis module 3910, and associated equipment can be used as a stand-alone system.

As discussed above, each of the locations equipped with passenger and/or item tracking 3920 can have their own tracking and analysis module 3910. Alternatively, a plurality of locations can communicate with a shared tracking and analysis module 3910. Each tracking and analysis module 3910 optionally includes the further capability of being able to communicate with a next higher-level tracking and analysis module 3910. With each higher-level tracking and analysis module 3910, the system becomes more comprehensive and is capable of basing the analysis on more information relating to items and passengers.

In general, airports, shipping ports, train stations, and the like, are often configured to have multiple concourses or terminals. Each concourse or terminal may have a plurality of different screening areas with each screening area having multiple threat scanning machines as illustrated in FIG. 39.

To achieve item and passenger tracking, an identification of each item and passenger needs to be present. For passengers, this identification is usually present and can be, for example, a boarding pass, a passport, a drivers license, a fingerprint, bioinformatics, or the like. In general, any identification that can be used to identify an individual will work equally well with the systems and methods of this invention.

Each item also needs to be identifiable. This identification can come in numerous formats including, but not limited to, a Radio Frequency Identification (RFID) tag or bar code associated with the item, shipment tracking information, shipment container information, or the like. While the exemplary embodiment will be discussed in relation to airline passengers and items, such as baggage, it is to be appreciated that the general concepts disclosed herein can be extended to any type of item in any type of environment. For example, the system can be extended to include vehicle tracking, cargo tracking, shipment tracking, or in general, tracking of any item or person. In general, provided there is a scanning and identification reading capability, such as a threat scanning machine, walkthrough metal detector, or the like, that is capable of reading an identifier associated with one more of an item and a passenger, that item and/or passenger can be tracked and a analysis of the contents performed. This analysis can include a comparison to historical information as well as a prediction about the future threat capabilities of an item, individual or group of individuals.

Up to this point, the threat scanning machines 106 have been discussed as having the capability of being able to detect objects readily identifiable as threats. However, the threat scanning machines 106 can also be configured to detect additional characteristics about an item, such as object(s) associated with the item, weight, color, dimensions, or in general any other information that could be useful to assist with the tracking and analysis of that particular item.

In operation, an item is-associated with a passenger. However, if the item is not passenger related, the item can be associated with, for example, the shipper, owner, sender, or in general any entity that is associated with the item. For example, in an airport type environment, the item, such as one or more pieces of baggage, can be associated with a passenger when the passenger checks-in their baggage at the ticket counter. This process could be implemented manually where, for example, the ticket agent enters information about the passenger and number of items. The check-in counter could also be equipped with suitable scanning equipment that is capable of associating one or more of an item identifier and passenger identifier with the item(s) and passenger(s), respectively.

Upon check-in, the item tracking module 3912 and passenger tracking module 3914 are updated with the item and passenger identification(s), respectively. For example, the item tracking module 3912 and passenger tracking module 3914 can store information indicating that "Passenger X" has 2 checked bags and one carry on. Upon arrival at the security checkpoint, a passenger generally places their carry-on baggage on a conveyor for scanning by a threat scanning machine 106 and passes through a walk through metal detector (WTMD) 3950. In conjunction with performing the threat analysis, the threat scanning machine 106 also obtains the item tracking identification associated with the scanned baggage and forwards the results of the threat scanning to the item tracking module 3912. These results can include, as discussed above, an identification of any threat, as well as any supplemental information regarding the baggage such as, for example, weight, contents, dimensions, or the like.

Similarly, the walk through metal detector 3950 can be equipped with a passenger identification scanning device, such as a bar code reader that may read a bar code associated with a boarding pass, passport, drivers license, or the like. Upon obtaining this passenger identification, the walk through metal detector 3950 forwards information to the passenger tracking module 3914 regarding, for example, the time, date, passenger destination information, passenger origination information (if the passenger was from a connecting flight or another area), or in general any other information that may be relevant to passenger tracking.

The passenger and item information, upon receipt at the tracking and analysis module 3910 can be stored and indexed as well as forwarded to additional tracking and analysis module(s) (not shown) as appropriate. For example, certain profiles can specify that, for example, all information obtained from the major airports and shipping terminals throughout the world be automatically forwarded to one or more higher-level tracking and analysis module(s) for storage and indexing. Similarly, all information relating to passengers traveling to a certain destination could be forwarded to a tracking and analysis module that analyses passenger and item traffic for a particular geographic region. In general, the handling of the passenger and item information can be configured in any manner as appropriate.

Advantageously, in addition to threat detection as previously discussed, the threat scanning machines 106 are configured with the capability of identifying contents within an item. For example, through the use of backscatter techniques, bills of ladings, the manual entry of contents within items, or the like, the threat scanning machines 106 are able to compile and forward to the item tracking module 3912 a list of contents within each item. As will be discussed in more detail hereinafter, it will become apparent that threats may not be one readily identifiable object but rather could be various pieces-and parts that could be assembled to create a threat. Thus the determination of all or a portion of the contents could be important and could also be accomplished automatically where, for example, the system detects content based on one or more of size, shape and density. By tracking contents within each item, and in conjunction with the analysis module 3916, the systems and methods of this invention are able to perform predictive analysis regarding whether a threat is present, or could be present, based on various contents that may or may not be associated with the same item, at the same location, or even it the same country.

Once the item tracking module 3912 and passenger tracking module 3914 receive the item and/or the passenger identification, as well as information associated with that item and/or passenger, the analysis module 3916 analyzes information associated with the item, such as contents, and information associated with the passenger, such as historical traveling patterns, or the like in an attempt to predict whether that item and/or passenger poses a threat.

For example, as previously discussed, a gun or a knife is a readily identifiable threat. However, it becomes more challenging when items which are not themselves considered as threats, are combined with other objects to become a threat. For example, a hammer, barrel and grip of a pistol taken by themselves are not a threat, but when combined obviously raise the status of the items to a threat. Less obvious items could be an aerosol can, a lighter and rubber band or tape. Again, while each of these devices alone may not present a threat, the rubber band or tape could be used to hold open the nozzle on the aerosol can thus creating a frame thrower. Similarly, BB's and glue are not in and of themselves threats, though if the glue was used to secure BB's to an explosive device, this would obviously cause the potential for concern due to the BB's being used as shrapnel. Similarly, numerous chemical materials by themselves do not pose a threat. However, when combined, could be a serious threat.

With the information obtained by the item tracking module 3912, the analysis module 3916 is capable of performing an analysis of all or a portion of the contents associated with the item, and compares the obtained information to, for example, information associated with one or more other items and/or passengers to determine if contents identified as non-threats could become threats if combined with other items.

For example, assume a Passenger A boards at London Heathrow Airport with chemical A in a carry-on bag. Passenger B boards an airplane in Atlanta with chemical B in a carry-on bag. Both passengers are destined for JFK and upon arriving at JFK, board a plane destined for LAX. As in the previous example, chemical A and chemical B taken alone do not pose a threat. However, chemical A and chemical B when combined produce an explosive and now, since both passengers are on the same flight, could present a threat. Similarly, through the tracking of items and passengers, the system can be used to determine if, for example, one of the passengers no longer has all or a portion of the chemicals in their possession. For example, it a coordinated attack where Passenger A is scheduled to pick-up chemical B at JFK, the threat scanning machines at JFK could determine when Passenger B passes through a threat scanning machine 106 that passenger B no longer has chemical B. The appropriate alerts could then be raised by the alarm module 3918 in relation to Passenger A and the appropriate security officials at the JFK airport notified. Similarly, a determination could be made about whether the weight of Passenger B's bag has changed and thus Passenger B may have only dropped off a portion of chemical B in the airport, thus raising two alarms, one for the passenger and one for airport security indicating the chemical could be present somewhere in the airport facility.

As another example, it may be desirable to keep Passenger A and Passenger B from traveling aboard the same aircraft. Similar to the above example, the threat scanning machine could be used to track whether Passenger A and Passenger B attempt to board the same aircraft. If they do, an appropriate alarm could be generated by the alarm module 3918.

The analysis module 3616 can take into consideration any relevant factor in determining whether a possible threat could exist. As with the previous examples, this information is not limited to content associated with an item, but can also include historical and future itineraries of the passenger, historical and future information about the item(s), origin and destination information about the items, and the like.

As discussed above, the network of threat scanning machines 106 could provide the information about items that allows the evaluation and analysis of contents to determine if there could be a group of related items that, when combined, could pose a threat. The analysis includes evaluation and analysis of the various items, and possibly a comparison to other items, for example through the use of an expert system, artificial intelligence, fuzzy logic, neural networks, or the like, to determine if a threat is present based on the various individual items and/or passengers. For example, the analysis of the items can account for historical information, origin information, destination information, and the like, as well as a comparison to other individuals' items and contents to determine if a threat exists.

In addition to the scanning by the one or more of the threat scanning machines 106, walk through metal detectors 3950, or any other scanning device or system that identify and forward information regarding items or passengers to one or more of the item tracking module 3912 and passenger tracking module 3914, manually entered information regarding items and passengers can also be forwarded to the item tracking module 3912 and passenger tracking module 3914.

For example, personnel manning a security checkpoint can forward information to one or more of the item tracking and passenger tracking modules that could be useful in determining whether a threat exists. For example, through the use of one or more of a passenger or item identifier, information regarding suspicious behavior of a passenger, a passenger leaving before boarding a plane, or the like, can also be taken into consideration by the analysis module 3916. Thus, it is to be appreciated, that not only can information be forwarded to the item tracking module 3912 and passenger tracking module 3914 prior to, for example, a passenger boarding in an aircraft, but information regarding that passenger and associated items be collected upon departure from the aircraft and/or airport. Therefore, the analysis module 3916 could do a comparison between passenger(s) and/or item(s) before and after the traveling.

The analysis module 3916 is accessing a hierarchy of information to assist with the analysis of items and passengers starting with, for example, other items and passengers that meet specific criteria. For example, the analysis module 3916 could first analyze items associated with a passenger at a particular threat scanning machine 106. If an alert is warranted based on this first tier of analysis, an alert can be sent to the appropriate destination with the cooperation of the alarm module 3918. Similarly, if the analysis warrants the raising of a risk level associated with one or more of the item and passenger, the network of command and control centers 3980 can be notified to indicate this change in risk level. Likewise, a determination can be made whether a broader analysis should be made and information regarding the item(s) and/or passenger(s) forwarded to a next higher-level tracking and analysis module. For example, if the passenger is flying on a local hop from Oklahoma City to Dallas-Fort Worth, and the passenger has been making the identical trip for the past seven months, with the same number, of items, it may not be necessary to forward information regarding that passenger and associated item(s) to the next higher-level tracking an analysis module. However, if, for example, the passenger is a first time flyer with the destination of Washington, D.C., and the passenger has no checked bags, and only one small carry-on bag, it may be advantageous to forward that passenger's information to a next higher level analysis module for comparison to, for example, other passengers and items on the same flight. This escalating analysis and forwarding can continue until a determination is made that an alert need not be sent, the risk level need not be raised, and further analysis need not be performed.

In an exemplary implementation, the analysis within an analysis module 3916 can be based on a comparison between item and passenger information and information stored in, for example a look-up table. This could be a simple one to one correlation and if certain conditions are satisfied, one or more of an alert, risk level and elevation to a next higher-level analysis module could be performed. Alternatively, or in addition, the analysis can be based on an expert system, an artificial intelligence system and/or in conjunction with human review of the information relating to items and passengers. With the hierarchical nature and capabilities of the analysis module to forward information to a next higher-level analysis module, cross-integration and comparison of information can be performed on a local basis all the way up to a global level that could include, air traffic, shipping traffic, public transportation traffic, cargo traffic, and the like. Similarly, different agencies, governments, other entities and the like can coordinate scanning and screening efforts.

The alarm module 3918 works in cooperation with the analysis module 3916 to send an appropriate alarm upon the analysis module 3916 determining that an alert is required. The alarm module 3918 is capable of sending an alert to a particular destination associated with a local threat scanning machine 106 or walk through metal detector 3950, as well a security group assigned to that geographic location, or, for example, where there is evidence of collaboration, to any other destination as may be appropriate. For example, and in accordance with the previous example where Passenger A with chemical A and Passenger B with chemical B are both preparing to travel to JFK, and then share a flight to LAX, the airports at London Heathrow, JFK, Atlanta, and the airlines on which they are traveling can all be notified by the alarm module 3918 that a threat may exist. The alarm module 3918 can also be used to send alerts and to raise a threat status based on the outcome of the analysis by the analysis module 3916.

As also alluded to earlier, if the passenger tracking module 3914 is tracking the whereabouts of passengers and their associated items, the frequency with which a passenger enters and reenters a screening area can be tracked and, for example, if the passenger(s) reenters too many times, it can trigger the sending of an alert or raising of the risk level by the alarm module 3918. Similarly, if the passenger enters numerous different screening areas, and they appear to be on the same flight, this could also trigger an alert or raising of the risk level by the alarm module 3918.

Taken a step further, flying habits can also be monitored and the hierarchy of the present invention is uniquely configured to monitor this type of information since the item tracking module 3912 and passenger tracking module 3914 are capable of forwarding their information to one or more centralized databases that can be accessed by one or more other analysis modules for performing threat assessment.

Even further, the passenger tracking module 3914 and item tracking module 3912 can cooperate with, for example, threat scanning machines 106 that are placed at the entrance of the airplane and can collect information related to one or more of items and passengers immediately prior to boarding. The analysis module could then perform an analysis between when the baggage went through a previous security checkpoint and the passenger/item bag as it is loaded onto the airplane. For example, a comparison can be made between the weight of a carry-on bag at the security checkpoint and the weight of the carry-on bag at the airplane. If a difference exists, there may be sufficient cause to send an alert and or alter a risk level. Similarly, equipment can be installed that allows the monitoring of the actual passenger(s) who board an aircraft. This information can be forwarded to an analysis module 3916 that can compare that information to information the tracking and analysis module 3910 already has regarding who should be on the airplane. If there is a discrepancy, one or more of the alert and/or entering of the risk level can be initiated.

The analysis by the analysis module 3916 can be based on one or more of any of the following: contents, number of items, weights, frequency of travel, duration of stay, origin information, destination information, connection information, owner information, a comparison to other items or passengers "in the system," a comparison to "common" content, trip patterns, historical travel information, port origination information, destination port information, number of passenger traveling together, relationship between the passengers, or the like.

For example, if the passenger is departing from Florida and heading to Alaska in the middle of the winter, and the passenger does not have any items such as extra winter clothing, an alert and/or risk level can be altered. Similarly, if a passenger's trip includes driving to a train station, taking a train from a first destination to a second destination, catching a plane to a third destination, and a ship to a fourth destination, the passenger and the items with that passenger can at least be checked every time the passenger changes their mode of transportation to verify continuity between the items that passenger has with them. If, for example, the content within an item has changed, during the course of the trip, one or more of an alert and/or altering of the risk level can be performed.

The report module 3922 can be used in conjunction with any component of the passenger and item tracking system to compile and produce reports related to any one or more of alarms, threat levels, items, passengers, status of the system, historical information, prediction information, or the like, and can be forwarded to any destination, such as a threat scanning machine adapted to receive communications from the passenger and item tracking system and/or one or more command and control centers, either electronically, such as in an e-mail or on a web page, or in a more traditional paper based manner.

Figure 40:
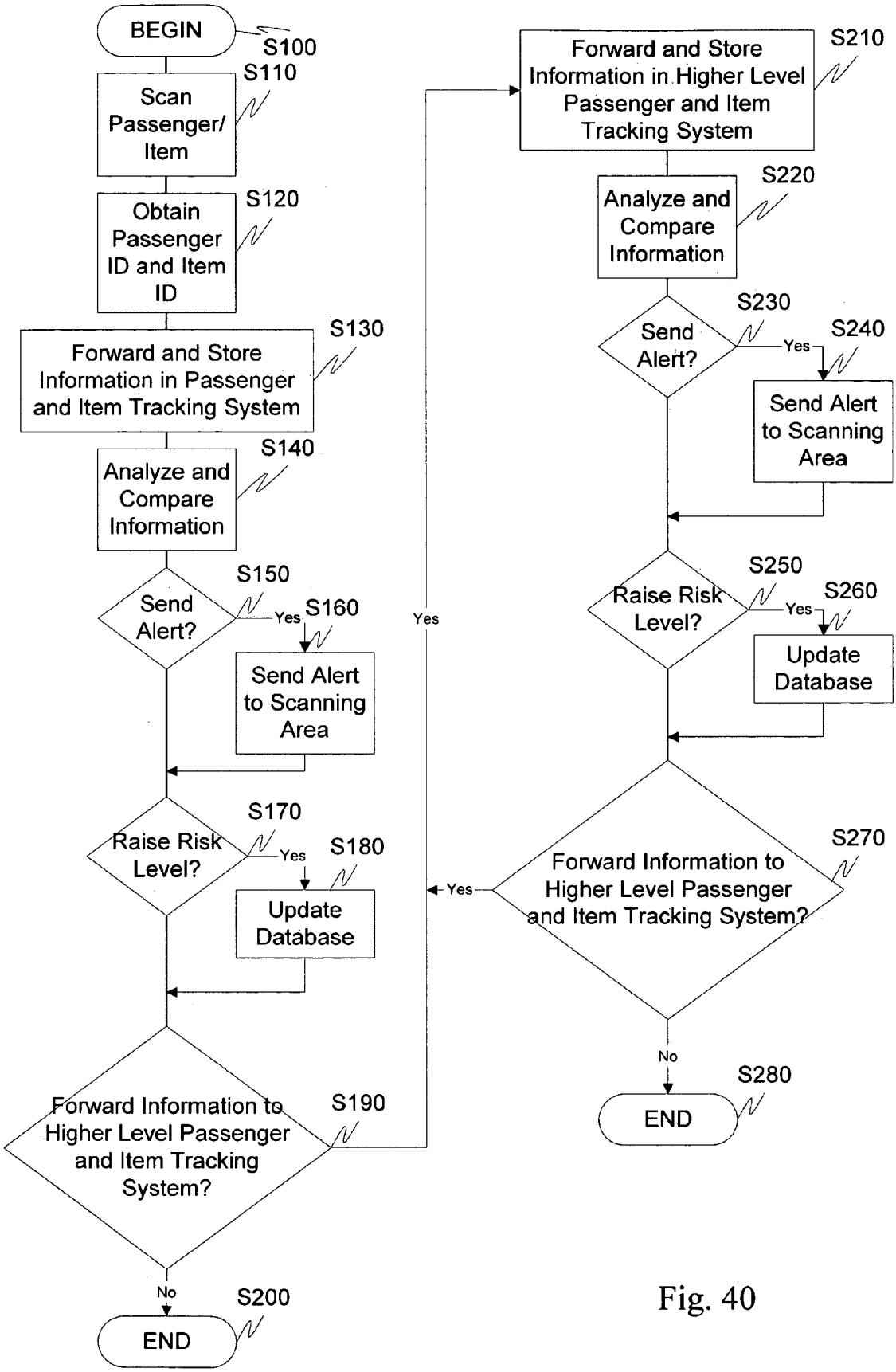
FIG. 40 is a flowchart illustrating an exemplary operation of the passenger and item tracking according to this invention.

FIG. 40 illustrates an exemplary method of operation of the passenger and item tracking system. In particular, control begins in step S100 and continues to step S110. In step S110 one or more of passengers and/or items are scanned. Next, in step S120, identifications corresponding to the scanned passengers and or items are obtained. Then, in step S130, the obtained scanning and identifications are forwarded to the passenger and item tracking system. Control then continues to step S140.

In step S140, an analysis is performed on the obtained information and compared to other information, such as, but not limited to historical information, base-line information, and the like. Control then continues to step S150 where a determination is made whether an alert should be sent based on the analysis. If an alert is to be sent, control continues to step S160 where an alert can be sent to one or more destinations and/or entities. For example, alert information can be forwarded to one or more "officials" and/or screeners. For example, if there is something suspicious about a person a screening position X, the alert information can be displayed the next time the person's identifier is displayed, e.g., at screening position Y. In this manner, both the operator and/or screening point Y can be alerted to the suspicion. Similarly, if there is a suspicious item, information about the item can be retrieved and displayed each time the item identifier is detected. For example, the alert information, or a derivative thereof can be displayed to a supervisory location, on a portion of an operators screen, on dedicated alarm information displaying equipment, on a wireless device(s), anywhere in the network of command and control centers, to an adjacent or governing agency, such as railways, police, FBI, etc., DHS, or the like. In a similar fashion, while alarm information can be forwarded vertically up the "chain of command" alert information can be distributed down the chain. For example, if an agency, such as the FBI, has a specific individual targeted, the system could be notified that upon presentation of that individual's identifier to the system, an alert could be sent, for example, back to the agency that specified the watch, can notify the location where the individual is to take appropriate action by, for example, manual screening, or the like.

Otherwise, control jumps to step S170 where a determination is made whether a risk level should altered. If a risk level is to be altered, control continues to step S 180 where a database is updated with the new risk information. This database can be collocated with a local passenger and item tracking system, and/or associated with the network of command and control centers. Control then jumps to step S190.

In step S190, a determination is made whether to forward the obtained information to a higher-level passenger and item tracking system. If the information is to be forwarded to a higher-level passenger and item tracking system, control continues to step S210. Otherwise, control jumps to step S200 where the control sequence ends.

In step S210, the obtained information is forwarded and stored at a higher-level passenger and item tracking system. In step S220, an analysis is performed on the obtained information and compared to other information, the scope of which can be specified in accordance with, for example, a set of rules. Control then continues to step S230 where a determination is made whether an alert should be sent based on the analysis. If an alert is to be sent, control continues to step S240 where an alert can be sent to one or more destinations and/or entities.

Otherwise, control jumps to step S250 where a determination is made whether a risk level should altered. If a risk level is to be altered, control continues to step S260 where a database is updated with the new risk information. This database can be collocated with a local passenger and item tracking system, and/or associated with the network of command and control centers. Control then jumps to step S270.

In step S270, a determination is made whether to forward the obtained information to a higher-level passenger and item tracking system. If the information is to be forwarded to a higher-level passenger and item tracking system, control jumps back to step S210, otherwise control jumps to step S280 where the control sequence ends.

Figure 41:
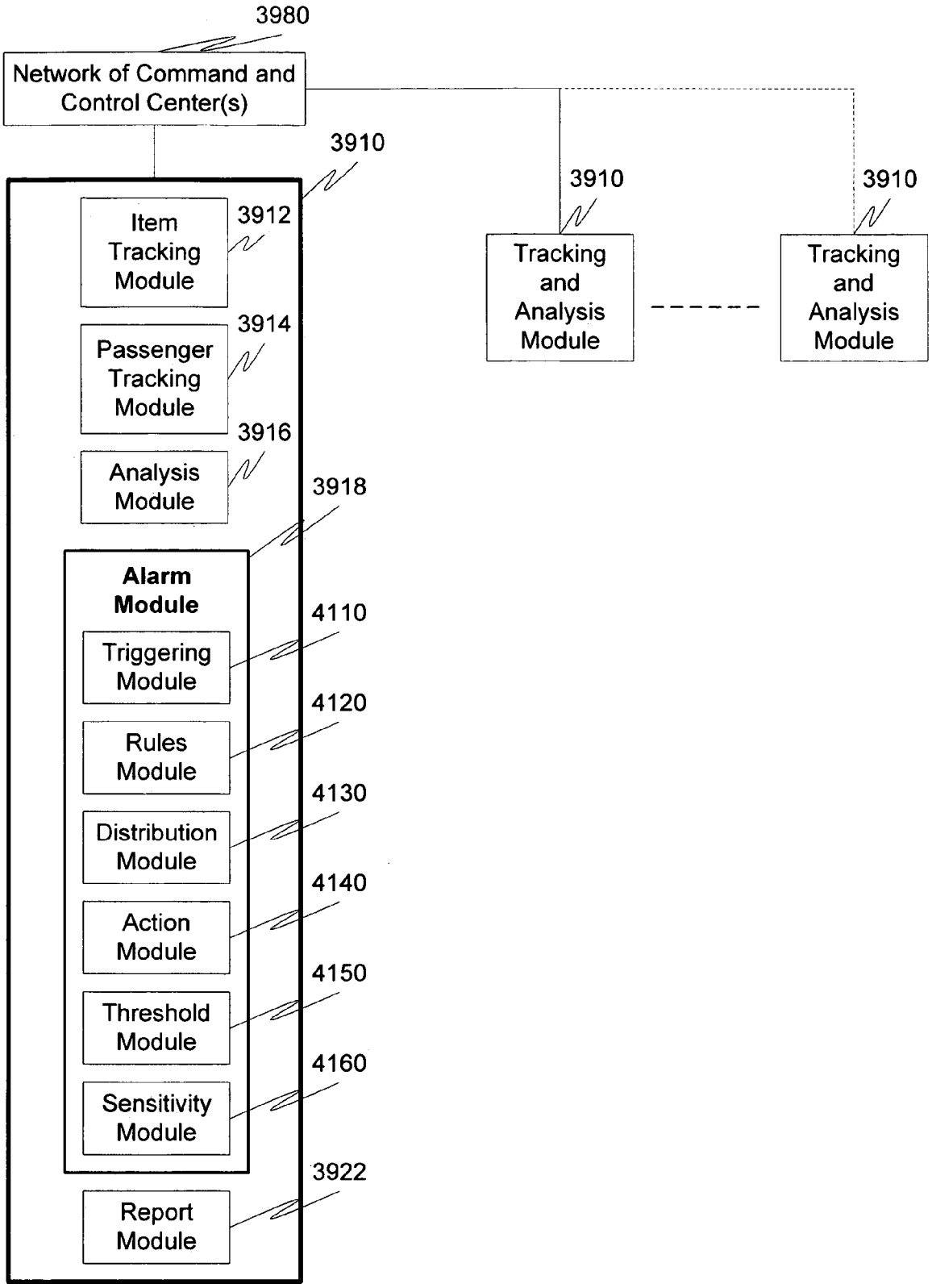
FIG. 41 is a functional block diagram illustrating in greater detail the alarm module according to this invention.

FIG. 41 illustrates in greater detail the tracking and analysis module 3910, and in particular, the alarm module 3918. Specifically, the alarm module comprises a triggering module 4110, a rules module 4120, a distribution module 4130, an action module 4140, a threshold module 4150 and a sensitivity module 4160. As previously discussed, the tracking and analysis module 3910 can be associated with, for example, a threat scanning machine, a plurality of threat scanning machines, and/or one or more command and control centers within the network of command and control centers 3980. For example, the tracking and analysis module 3910 can be strategically positioned at any location and can cooperate with any number of threat scanning machines and/or command and control centers. In particular, in a basic exemplary embodiment, the tracking and analysis module 3910 can be associated with, or even installed in, a threat scanning machine 106 as a stand-alone unit.

As an illustrative operational example, assume a first threat scanning machine detects a threat. The threat scanning machine cooperating with the tracking and analysis module 3910, and in particular the alarm module 3918, determines an action to take based on the threat. This can include, for example, notifying other threat scanning machines and/or operators within a predefined area, communicating alarm information to a plurality of threat scanning machines within a geographic area, forwarding alarm information corresponding to the threat to a command and control center, or the like. As will be discussed in more detail hereinafter, rules can define the action of the alarm module 3918, with the rules capable of being static or dynamic.

In general, and in accordance with an exemplary embodiment, the actions associated with the alarms can be broken into three categories. The first category of action specifies when an alarm should be triggered. The second category of action specifies which actions are to be performed based on the triggering of an alarm. The third category of action specifies what reaction an alarm receiver, such as a threat scanning machine, command and control center(s), or the like, performs based on the receipt of alarm information.

In operation, and as previously discussed, the alarm could be generated automatically, for example upon the detection of a threat. The alarm could also be generated through an automatic and manual combination where, for example, a threat scanning machine forwards notification to a human operator who then makes the determination as to whether an alarm should be raised, or totally manually, where an operator is entirely responsible for raising an alarm. For example, in an automated or semi-automated mode of operation, the analysis module 3916, could forward to the alarm module 3918 an instruction indicating that an alarm is warranted. Upon receipt of an alarm notification, the triggering module 4110 cooperates with the rules module 4120 to determine an appropriate course of action.

The semi-automatic mode could also be configured so that some items would be forwarded automatically and others would require a human to "hit the OK button" before sending. Furthermore, the totally manual mode could require a human to "hit the OK button" every time before sending. In general, the system could do the determination of a situation that would require the notification, although there might be human effort in determining such. Once the system determines that something needs to be sent based on the rules, the system could automatically send all alarms, automatically send some, require manual approval for others, or require manual OK for all alarms.

Specifically, the triggering module 4110 cooperates with the rules module 4120 to determine if alarm information need be generated, and if so, how to handle the alarm information. For example, the rules module could specify that the alarm information be sent out to one or more destinations. Utilizing logic based on rules in the rules module 4120, the triggering module 4110 cooperates with the distribution module 4130 to initiate various types of action.

Table 8 outlines exemplary responses and actions that can be activated by the triggering module 4110 based on rules within the rules module 4120.

TABLE 8

Responses and Actions

| Alarm | Response |
|---|---|
| At TSM | Forward to Adjacent TSM's |
| At TSM with certain Characteristics | Forward to all TSM's within Predetermined Area |
| At TSM and an Explosive Device | Automatically Forward to Predetermined Command and Control Center(s) |
| Activated by Operator | Analyze Nature of Alert and Forward to Appropriate Destination(s) |
| At Local TSM | Analyze Threats At Other Locations To Dynamically Determine Subsequent Action, Update Rules based on Determination |

Alarms can be based on, for example, the type of threat discovered, e.g., an explosive verses a weapon, and weapons can, for example, can be broken into different types such as "sharp" weapons, e.g., knives, and blunt objects such as baseball bats. For some instances, for example, such as a carry on item for a plane, a baseball bat could be considered a threat and trigger an alarm. However, if the same baseball bat was placed in checked baggage it would not be considered a threat. The rules within the rules module 4120 can account for these types of variances and can be configured and updated, as discussed hereinafter in relation to, for example, the modifying of thresholds and sensitivities, to account for these types of variations.

In addition to rules that specify one or more actions to take based on a received alarm, the rules module 4120 can include rules that specify thresholds and/or sensitivities. For example, if a trace amount of a particular chemical is found, the trace amount might not warrant raising an alarm. However, if a substantial amount of that same chemical is found, or an amount above a predetermined amount, an alarm can be raised. It is therefore possible to adjust the sensitivities of both the analysis module 3916 that determines if there is an alarm, and the alarm module 3918 that determines what action to take upon receipt of the alarm. Similarly, with sensitivity, one or more of a threat scanning machine's sensitivity, the analysis module's sensitivity and the alarm module's sensitivity to one or more items, can be adjusted based on, for example, a higher likelihood that someone may be trying to introduce a particular item into a secure area, such as on an airplane. For example, if a barrel of a gun is detected at a threat scanning machine, other threat scanning machines can have the sensitivity toward other gun components elevated.

Once a determination is made that a response need be generated in response to an alarm, the distribution module 4130 is activated. In particular, and as previously discussed, the distribution module 4130 can operate in a completely automatic manner, a semi-automatic manner and/or a manual manner. For example, in accordance with an exemplary fully automatic mode of operation, the distribution module 4130 can distribute alarm information based on, for example, rules in the rules module 4120. Furthermore, the distribution module 4130 can distribute alarm information in a semi-automatic manner where, for example, the distribution module 4130 may determine, in accordance with the rules in the rules module 4120, that alarm information should be sent to a particular group of destinations. This compiled group of projected recipients could then be forwarded to, for example, an operator or a command and control center for approval prior to distribution. Upon confirmation that the alarm information and intended recipients are appropriate, or after editing, the distribution module 4130 can forward the alarm information in the usual manner. Furthermore, alarm information can be manually entered and distributed with the aid of distribution module 4130. For example, an operator or, for example, a supervisor at one or more command and control centers can specify that alarm information is to be sent to one or more tracking and analysis modules. The distribution module 4130 could then distribute the alarm information in accordance with the operator's and/or supervisor's instructions.

Take, for example, a situation where an operator identifies a passenger carrying a particular threat. Upon the operator notifying the passenger tracking module 3914, through the use of a special flag, of the attempted security breech by that passenger, the analysis module 3916, in conjunction with the triggering module 4110 and rules module 4120, recognizing the special flag, could forward, with the cooperation of the distribution module 4130, alarm information to any one or more of a tracking and analysis module 3910 and a command and control center.

As with the tracking and analysis module 3910, the alarm module 3918 can be distributed and configured in a hierarchal manner. Thus, for example, if a particular "local"

distribution module 4130 determines that alarm information should be distributed, and subsequently forwards that alarm information to a number of destinations, one or more command and control centers can act as an overseer confirming that the action is appropriate and maintaining the ability to recall, edit and supplement destinations for the alarm information. Furthermore, if a particular tracking and analysis module 3910 is unable to determine whether alarm information should be distributed, the tracking and analysis module 3910 can cooperate with a next higher-level tracking and analysis module such that a collaborative effort could be used to determine whether alarm information need be distributed. Furthermore, and in accordance with another exemplary embodiment, the distribution module 4130 can cooperate with one or more command and control centers and reconcile the rules in the rules module 4120 with the rules stored at one or more of the command and control centers. Thus, the distribution module 4130 could, for example, in response to a particular threat, forward alarm information to a command and control center for performing a supplemental analysis based on, for example, a rule set at the command and control center. It should be appreciated that this could allow a "master" rule set would have the capability of supplementing or overriding one or more rules in the rules module 4120.

The distribution module 4130 could also be configured to contact one or more specific command and control centers to determine, for example, distribution information. The command and control centers, in cooperation with the triggering module 4110, the rules module 4120 and the distribution module 4130 could collaborate and determine if, and where, to send the alarm information. Given the hierarchal arrangement of the system, a command and control center has the capability of overseeing and forwarding, for example, alarm information to a scanning area where the threat was found, to the concourse or geographic area where the threat was found, to all threat scanning machines within the airport, to one or more other command and control centers and/or threat scanning machines outside the airport, nationally or internationally, to another transportation and/or secured facility, or the like. In general, the system can be configured in any manner to allow collaboration, hierarchical verification of distribution information, or the like.

Upon the distribution of alarm information by the distribution module 4130, an action module 4140 located at one or more of a command and control center and another tracking and analysis module receives the alarm information. The action module 4140, in cooperation with, for example, rules stored therein, or information associated with the alarm information, performs an action based on the received alarm information. For example, the action module 4140 can alter, in cooperation with the threshold module 4150, threshold levels in, for example, an automatic or semi-automatic manner. For example, if a particular chemical has gone through another threat scanning machine on the same concourse, other threat scanning machines on the same concourse could be instructed to adjust their threshold levels in attempt to regulate the amount of that chemical allowed through security.

Similarly, the action module 4140 can specify a change in sensitivity for one or more particular items. Again, this can occur in an automatic or semi-automatic manner where, for example, if a portion of a gun is detected at a particular threat scanning machine, the sensitivity at the sensitivity module 4160 can be adjusted in an effort to more accurately detect an attempt to smuggle other gun parts into a secure area.

Furthermore, the action module 4140 can notify one or more of operators, security personnel, or personnel at one or more command and control centers. For example, notification such as a text or icon can be displayed on a threat scanning machine indicating, for example, a threat has been detected. This notification could be a text or an icon representing the threat that was found on another threat scanning machine, or could be, for example, an instruction to the operator(s).

If one or more of the threshold module 4150, sensitivity module 4160 and rules module 4120 were updated, a notification of the update and optionally specifics related thereto could also be forwarded to the operator indicating, for example, a change in threshold or sensitivity levels. Furthermore, pictures or diagrams could be displayed on one or more threat scanning machines to highlight, for example, what items have been found, and what items are to be specifically looked for. If, for example, a handgun handle is found by one threat scanning machine, the other threat scanning machines could display the handgun handle graphically and could highlight the remaining components, such as the barrel, hammer, bullets, and the like, indicating that there may be an attempt to bring these other components through their threat scanning machine.

In that the tracking and analysis module 3910 can be configured in the hierarchal configuration as previously discussed, additional exemplary advantages and benefits based on this configuration can be achieved. For example, the distribution module 4130 can be configured to manage one or more geographically defined regions, such as, regions within an airport, county, country, geographical locations based on, for example, political boundaries, local resources, target areas, or the like. For example, it may be advantageous to notify a specific threat scanning machine at a particular location along one or more particular commuters' paths that a particular individual is a threat, and to carefully screen that person. For example, in conjunction with the passenger tracking module 3914, the image of one or more "high-risk" passengers could be distributed and displayed at one or more threat scanning machines to advise the operators of those machines that extra attention may be warranted when scanning this individual.

The distribution module 4130 could also forward the alarm information based on, for example, the intended use of the threat. For example, if the threat is something that could be used on a ship, the threat scanning machines at seaports and/or near seaports could be notified. In general, the distribution module 4130, in cooperation with the one or more sets of rules, can adapted to any configuration based on, for example, one or more of threats, passengers, items, location(s), or the like.

Furthermore, while the above-described embodiment discusses the cross-integration and sharing of information through a hierarchy of tracking and analysis modules and network of command and control centers, is to be appreciated that the flow of information could also be from a higher-level to a lower-level. For example, if a threat is found in an airport in a particular city, a local command and control center could communicate alert information directly to, for example, that cities railway command and control center. This could eliminate the need for the alert information to flow up the hierarchy of command and control centers then back down to a specific command and control center.

These basic principles can be expanded to include intercommunication with various government agencies such as the Department of Homeland Security, NSA, FBI, CIA, and the like. The system could also be configured such that access to one or more command and control centers is provided to one or more of these various agencies, thus providing them with the capability of initiating an alarm, modifying threshold or sensitivity values, updating the rules, and the like. For example, if the Department of Homeland Security indicates that the national threat level needs to be modified, a change to one or more of the rules, thresholds and sensitivities can be initiated and promulgated down through the various command and control centers to each alarm module 3918 and/or analysis module 3916. This can be further expanded to include, for example, government agencies from other nations by allowing them the ability to both forward and receive alarm information, as well as distribute and receive rules, threshold values and sensitivity values around the world, to any location where a threat scanning machine is in operation.

For example, the Department of Homeland Security may initiate a program where all passengers destined for the United States on an airline must past through a Department of Homeland Security (DHS) approved threat scanning machine. Thus, various DHS approved threat scanning machines could be distributed around the world at all locations and airports where passengers depart for the United States. Thus, a command and control center managed by the United States could be configured to monitor rules, thresholds, and or sensitivities to aid in, for example, assuring uniform scanning of all inbound passengers.

Figure 42:
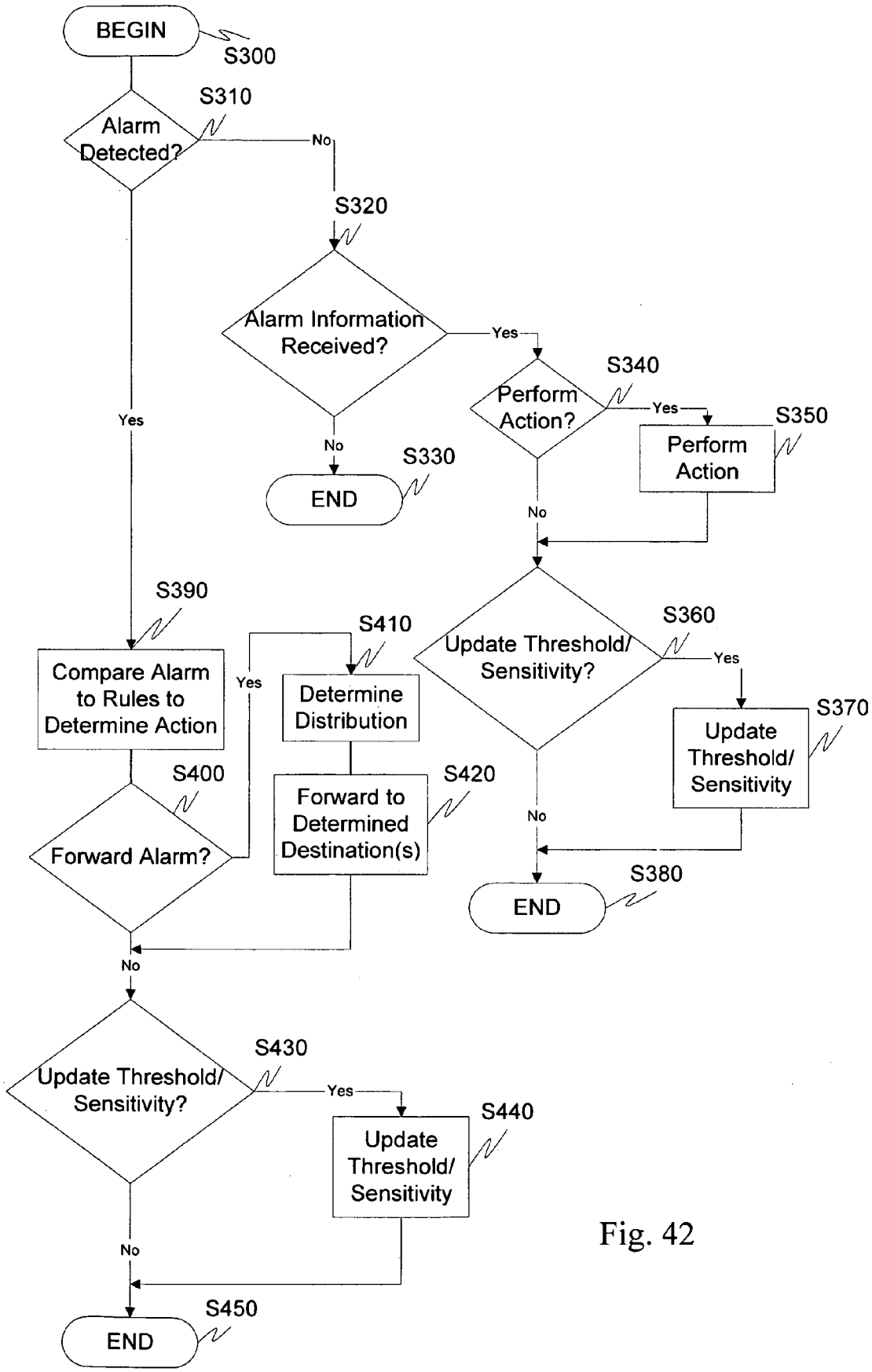
FIG. 42 is a flowchart illustrating an exemplary operation of sending alarms according to this invention.

FIG. 42 outlines an exemplary method of operation of the alarm module 3918. In particular, control begins at step S300 and continues to step S310. In step S310, a determination is made whether an alarm has been detected. If an alarm has not been detected, control continues to step S320. Otherwise, control jumps to step S390.

In step S320, a determination is made whether alarm information has been received. If alarm information has been received, control continues to step S340. Otherwise, control continues to step S330 where the control sequence ends.

In step S340, a determination is made whether an action should be performed based on the received alarm information. If an action is to be performed, control continues to step S350. Otherwise, control jumps to step S360.

In step S350, an action is performed. For example, a message can be sent to one or more of an operator at a threat scanning machine, various official(s), such as airport security, or the like, rules can be updated, passenger and/or item status updated, and the like. Control then continues to step S360.

In step S360, a determination is made whether one or more of threshold and sensitivity values should be updated. If the values are to be updated, control continues to step S370. Otherwise, control jumps to step S380 where the control sequence ends.

In step S370, the threshold and/or sensitivity values are updated. Control then continues to step S380 where the control sequence ends.

In step S390, information associated with the alarm is compared to one or more rules to determine an action. Next, in step S400, a determination is made whether to forward information about the alarm to one or more destinations. If information about the alarm is to be forwarded, control continues to step S410. Otherwise, control jumps to step S430.

In step S410, a determination is made as to which location(s) the alarm information is to be distributed. Next, in step S420, the alarm information is forwarded to the determined destinations. Control then continues to step S430.

In step S430, a determination is made whether the threshold and/or sensitivity values should be updated based on the alarm. If one or more of the threshold and/or sensitivity values are to be updated, control continues to step S440. Otherwise, control jumps to step S450 where the control sequence ends.

In step S440, one or more of the threshold and/or sensitivity values are updated. Control then continues to step S450 where the control sequence ends.

As shown in the above figures, the threat scanning machine management system with system alerts can be implemented on a general-purpose computer, a special-purpose computer, a programmed microprocessor or microcontroller and peripheral integrated circuit element, an ASIC or other integrated circuit, a digital signal processor, a hardwired electronic or logic circuit such as a discrete element circuit, a programmed logic device such as a PLD, PLA, FPGA, PAL, or the like. In general, any process capable of implementing the functions described herein can be used to implement the system and methodology according to this invention.

Furthermore, the disclosed system may be readily implemented in software using object or object-oriented software development environments that provide portable source code that can be used on a variety of computer platforms. Alternatively, the disclosed system may be implemented partially or fully in hardware using standard logic circuits or a very large-scale integration (VLSI) design. Other hardware or software can be used to implement and supplement the systems in accordance with this invention depending on the speed and/or efficiency requirements of the system, the particular function, and/or a particular software or hardware system, microprocessor, networking, or microcomputer system being utilized. The system illustrated herein can readily be implemented in hardware and/or software using any known or later developed systems or structures, devices and/or software by those of ordinary skill in the applicable art from the functional description provided herein and with a general basic knowledge of the computer and network communication arts.

Moreover, the disclosed methods may be readily implemented in software executed on programmed general-purpose computer, a special purpose computer, a microprocessor, or the like. In these instances, the systems and methods of this invention can be implemented as a program embedded on personal computer such as JAVA® or Common Gateway Interface (CGI) script, as a resource residing on a server or graphics workstation, as a routine embedded in a dedicated security system, or the like. The system can also be implemented by physically incorporating the system and method into a software and/or hardware system, such as the hardware and software systems of a security network.

It is, therefore, apparent that there is provided in accordance with the present invention, systems and methods for managing threat scanning machines with passenger and item tracking and system alerting. While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

What is claimed:

1. An alarm handling system comprising:

an item tracking module configured to read an item identifier associated with an item;

a passenger tracking module configured to read a passenger identifier associated with a passenger;

a triggering module utilizing rules to determine an action in response to a threat detected for the item at a first threat scanning machine, the rules including associating a read item identifier with a read passenger identifier;

a distribution module capable of performing the action, the action capable of including forwarding alarm information to a second threat scanning machine geographically remote from the first threat scanning machine.

2. The system of claim 1, further comprising an action module adapted to receive one or more of an instruction from a command and control center and incoming alarm information and performing an operation based thereon.

3. The system of claim 1, wherein the first threat scanning machine is in a first transportation concourse and the second threat scanning machine is in a second transportation concourse.

4. The system of claim 1, further comprising a sensitivity module adapted to cooperate with a rules module and the triggering module to determine the action.

5. The system of claim 1, wherein the analysis module is adapted to detect the threat at the threat scanning machine.

6. The system of claim 1, wherein a plurality of alarm handling systems are interconnected.

7. The system of claim 6, wherein the plurality of alarm handling systems are adapted to cooperate to perform threat detection and the action determination.

8. The system of claim 1, wherein the rules specify an automatic action to be taken in response to the detected threat.

9. The system of claim 1, wherein the distribution module is adapted to distribute one or more of the alarm information, the sensitivity information, the threshold information and the information for the analysis module based on distribution information associated with the action.

10. An alarm handling method comprising:

utilizing rules to determine an action in response to a threat detected at a first threat scanning machine; and performing the action, the action capable of including forwarding alarm information, updating sensitivity information at a second threat scanning machine, updating threshold information and updating information in an analysis module, wherein the first threat scanning machine is geographically remote from the second threat scanning machine.

11. The method of claim 10, further comprising receiving one or more of an instruction from a command and control center and incoming alarm information and performing an operation based thereon.

12. The method of claim 10, wherein the first threat scanning machine is located at a first transportation facility and the second threat scanning machine is located at a second transportation facility remote from the first transportation facility.

13. The method of claim 10, further comprising utilizing sensitivities to determine the action.

14. The method of claim 10, wherein the threat detected at the first threat scanning machine relates to a first screened person and wherein updating threshold information includes modifying an alarm threshold of the second threat scanning machine for a second person to be screened.

15. The method of claim 10, wherein the alarm handling method is performed by a hierarchy of alarm handling systems.

16. The method of claim 10, wherein the first threat scanning machine is in a first concourse of an airport and the second threat scanning machine is in a second concourse of the airport.

17. The method of claim 10, further comprising distributing one or more of the alarm information, the sensitivity information, the threshold information and the information for the analysis module based on distribution information associated with the action.

18. An alarm handling system comprising:

means for tracking an identity of a passenger;

means for tracking an item associated with the passenger;

means for utilizing rules to determine an action in response to a threat detected at a threat scanning machine responsive to the means for tracking the identity of a passenger and the means for tracking an item associated with a passenger; and means for performing the action, the action capable of including forwarding alarm information, updating sensitivity information, updating threshold information and updating information in an analysis module.

19. The system of claim 18, further comprising means for distributing one or more of the alarm information, the sensitivity information, the threshold information and the information for the analysis module based on distribution information associated with the action.

20. The system of claim 18, wherein the action is capable of including forwarding alarm information to a facility remote from the threat scanning machine.

* * * * *